US009145652B2

(12) United States Patent
Maus et al.

(10) Patent No.: US 9,145,652 B2
(45) Date of Patent: Sep. 29, 2015

(54) END TREATMENTS AND TRANSITIONS FOR WATER-BALLASTED PROTECTION BARRIER ARRAYS

(71) Applicants: Geoffrey B. Maus, Mission Viejo, CA (US); Felipe Almanza, San Clemente, CA (US); Jeremy Smith, San Clemente, CA (US)

(72) Inventors: Geoffrey B. Maus, Mission Viejo, CA (US); Felipe Almanza, San Clemente, CA (US); Jeremy Smith, San Clemente, CA (US)

(73) Assignee: TRAFFIX DEVICES, INC., San Clemente, CA (US)

( * ) Notice: Subject to any disclaimer, the term of this patent is extended or adjusted under 35 U.S.C. 154(b) by 0 days.

(21) Appl. No.: 14/257,389

(22) Filed: Apr. 21, 2014

(65) Prior Publication Data

US 2015/0010351 A1 Jan. 8, 2015

Related U.S. Application Data

(62) Division of application No. 13/371,269, filed on Feb. 10, 2012, now Pat. No. 8,777,510.

(60) Provisional application No. 61/442,091, filed on Feb. 11, 2011.

(51) Int. Cl.
*E01F 15/08* (2006.01)
*E01F 15/14* (2006.01)

(52) U.S. Cl.
CPC ..... *E01F 15/08* (2013.01); *E01F 15/086* (2013.01); *E01F 15/088* (2013.01); *E01F 15/146* (2013.01)

(58) Field of Classification Search
CPC ..... E01F 15/18; E01F 15/086; E01F 15/088; E01F 15/146
USPC ..... 404/6, 9; 256/13.1
See application file for complete search history.

(56) References Cited

U.S. PATENT DOCUMENTS

| | | | | |
|---|---|---|---|---|
| 4,500,225 | A | 2/1985 | Quittner | |
| 4,645,375 | A * | 2/1987 | Carney, III | 404/6 |
| 4,681,302 | A | 7/1987 | Thompson | |
| 4,869,617 | A | 9/1989 | Chiodo | |
| 5,007,763 | A * | 4/1991 | Burgett | 404/6 |

(Continued)

FOREIGN PATENT DOCUMENTS

KR 10-2007-0057742 A 6/2007

OTHER PUBLICATIONS

International Search Report and Written Opinion. Corresponding to PCT/US2012/024754. International filing date Feb. 10, 2012.

*Primary Examiner* — Abigail A Risic
(74) *Attorney, Agent, or Firm* — Donald E. Stout; Stout, Uxa & Buyan, LLP

(57) ABSTRACT

An end treatment array for crash attenuation includes a transition barrier module formed of side walls, end walls, a top wall, and a bottom wall, wherein the module walls together define an enclosed interior space. The end treatment array further includes a containment impact sled having an axially extending frame. The frame has a width sufficient to contain the transition barrier module within the frame when in an assembled configuration, and has an axial length which is at least one-half the length of the transition barrier module. The frame defines an interior volume, the purpose of which is to contain a substantial portion of the transition barrier module in the assembled configuration, and to contain debris caused by destruction of the plastic barrier modules in a vehicular impact. The containment impact sled is attached to the transition barrier module.

22 Claims, 21 Drawing Sheets

(56) References Cited

U.S. PATENT DOCUMENTS

| | | | | | |
|---|---|---|---|---|---|
| 5,030,029 | A | | 7/1991 | Johnsen | |
| 5,425,594 | A | | 6/1995 | Krage et al. | |
| 5,498,101 | A | | 3/1996 | Braverman | |
| 5,605,413 | A | | 2/1997 | Brown | |
| D400,264 | S | | 10/1998 | Striefel et al. | |
| 5,882,140 | A | | 3/1999 | Yodock, Jr. et al. | |
| 5,988,934 | A | | 11/1999 | Wasserstrom | |
| 6,059,487 | A | * | 5/2000 | Haga et al. | 404/6 |
| 6,059,491 | A | | 5/2000 | Striefel et al. | |
| D431,657 | S | | 10/2000 | Wasserstrom | |
| 6,126,144 | A | * | 10/2000 | Hirsch et al. | 256/13.1 |
| 6,203,242 | B1 | | 3/2001 | Englund | |
| 6,413,009 | B1 | | 7/2002 | Duckett | |
| D462,126 | S | | 8/2002 | Englund | |
| 6,474,904 | B1 | | 11/2002 | Duckett et al. | |
| 6,666,616 | B2 | | 12/2003 | Yodock, III et al. | |
| 6,669,402 | B1 | | 12/2003 | Davis et al. | |
| 6,863,468 | B2 | | 3/2005 | Davis et al. | |
| 7,037,029 | B2 | * | 5/2006 | Buehler et al. | 404/6 |
| 7,220,077 | B2 | | 5/2007 | Humphries et al. | |
| 7,393,154 | B1 | * | 7/2008 | Dyke et al. | 404/6 |
| 7,618,212 | B2 | | 11/2009 | Yodock et al. | |
| 2004/0057792 | A1 | | 3/2004 | Yodock, III et al. | |
| 2004/0096273 | A1 | | 5/2004 | Yodock, III et al. | |
| 2004/0146347 | A1 | | 7/2004 | Davis et al. | |
| 2007/0243015 | A1 | * | 10/2007 | Yodock et al. | 404/6 |
| 2008/0118305 | A1 | | 5/2008 | Carey | |
| 2009/0060650 | A1 | * | 3/2009 | Kulp et al. | 404/6 |
| 2009/0110480 | A1 | * | 4/2009 | Yodock et al. | 404/6 |
| 2010/0111602 | A1 | * | 5/2010 | Yodock et al. | 404/6 |
| 2010/0196094 | A1 | | 8/2010 | Kulp et al. | |
| 2012/0177439 | A1 | * | 7/2012 | More et al. | 404/6 |
| 2012/0269574 | A1 | * | 10/2012 | Redlberger | 404/6 |

* cited by examiner

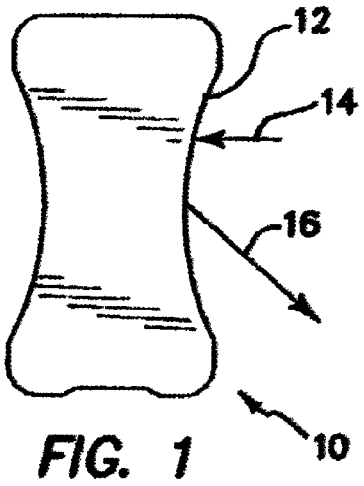
FIG. 1
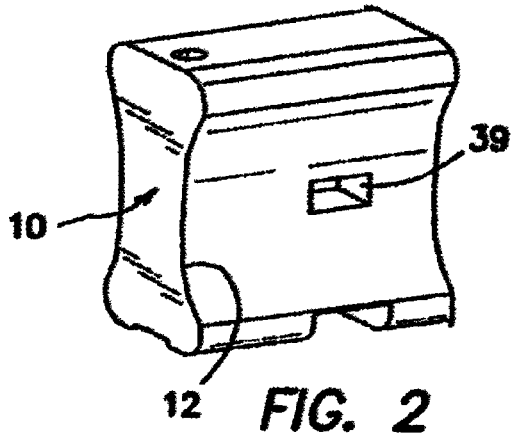
FIG. 2
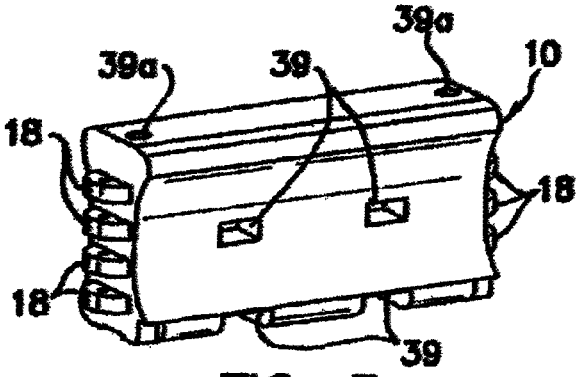
FIG. 3
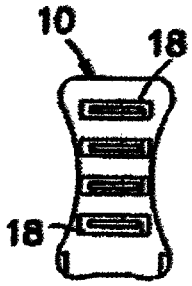
FIG. 5
FIG. 4
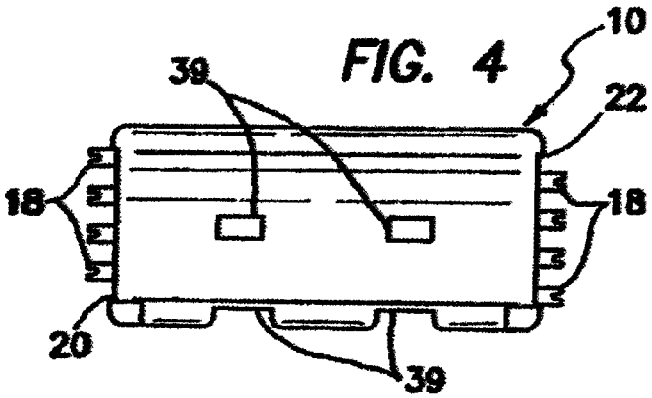
FIG. 6
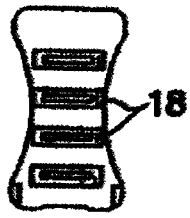

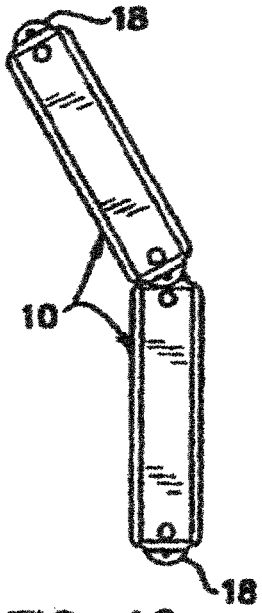
FIG. 12
FIG. 13
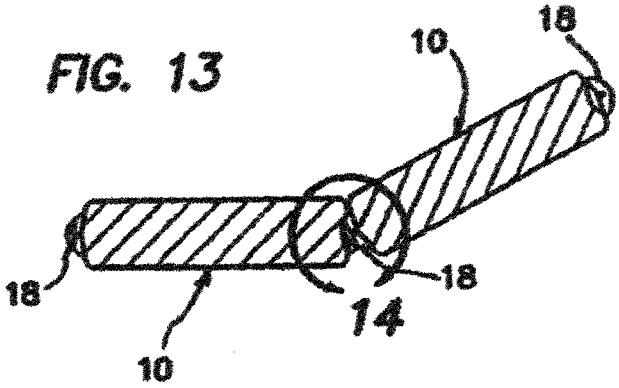
FIG. 14
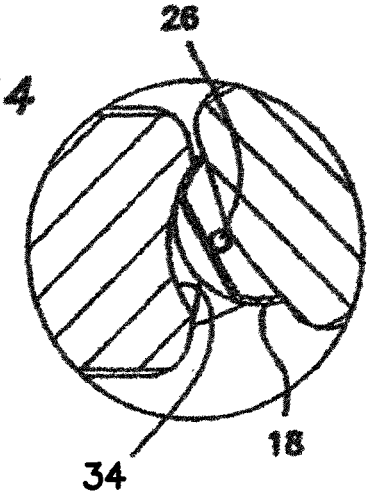
FIG. 15
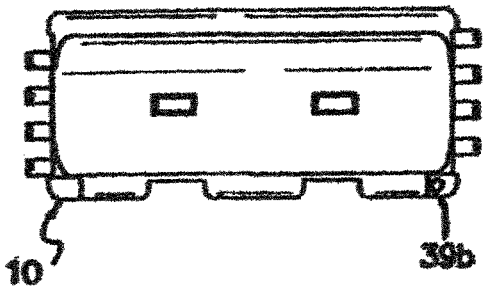
FIG. 16
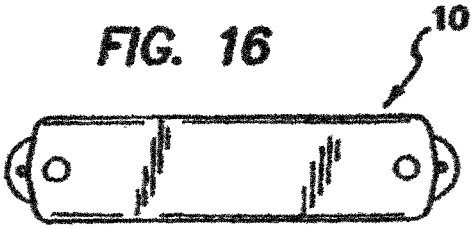
FIG. 17
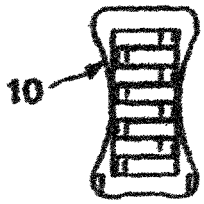

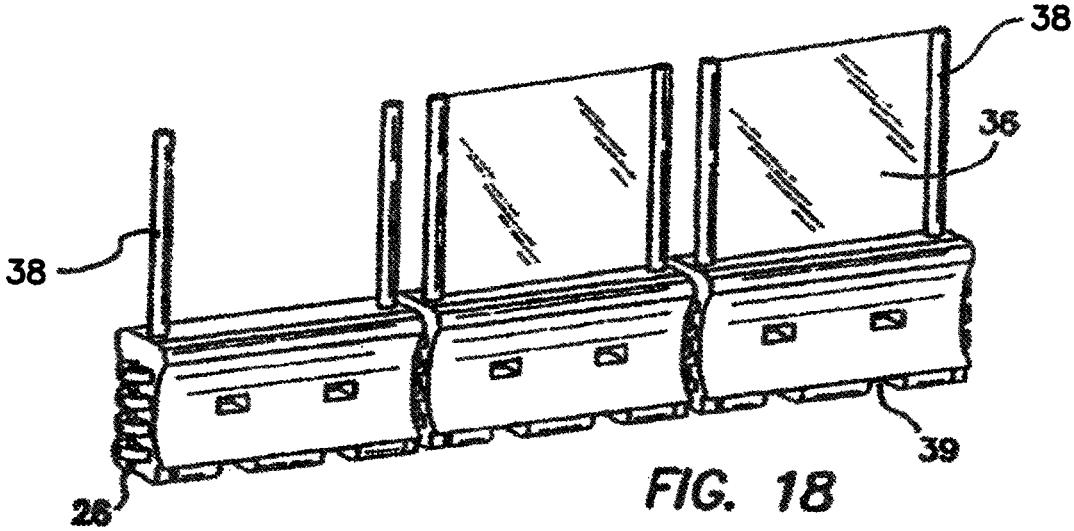
FIG. 18
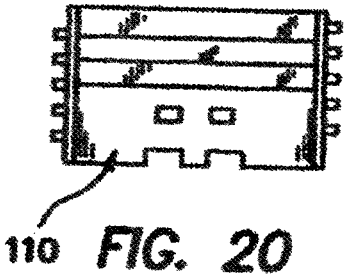
FIG. 20
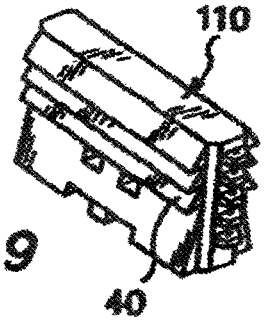
FIG. 19
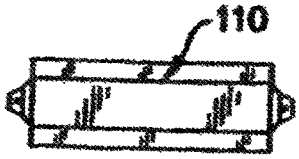
FIG. 22
FIG. 21
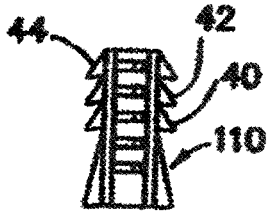

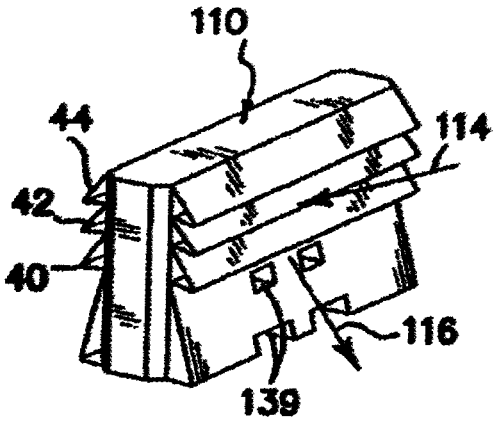
FIG. 23
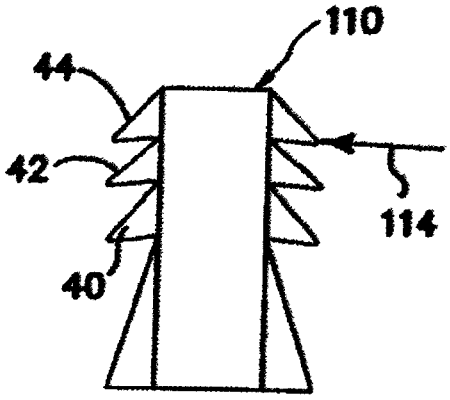
FIG. 24
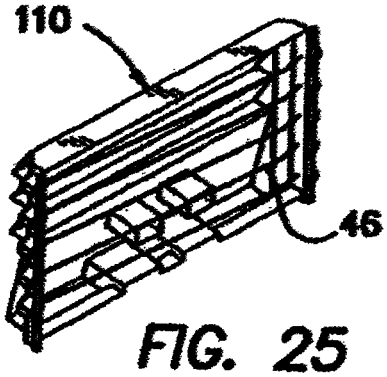
FIG. 25
FIG. 27
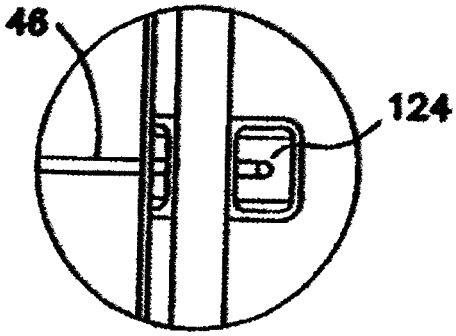
FIG. 26
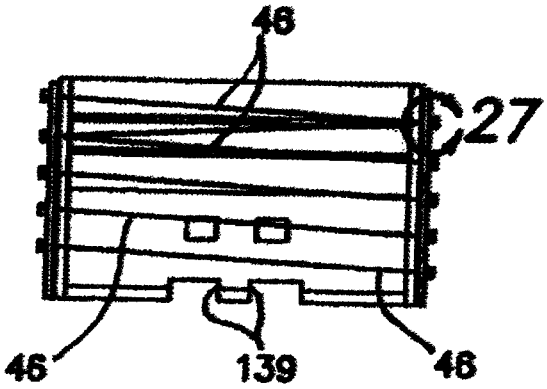

FIG. 35
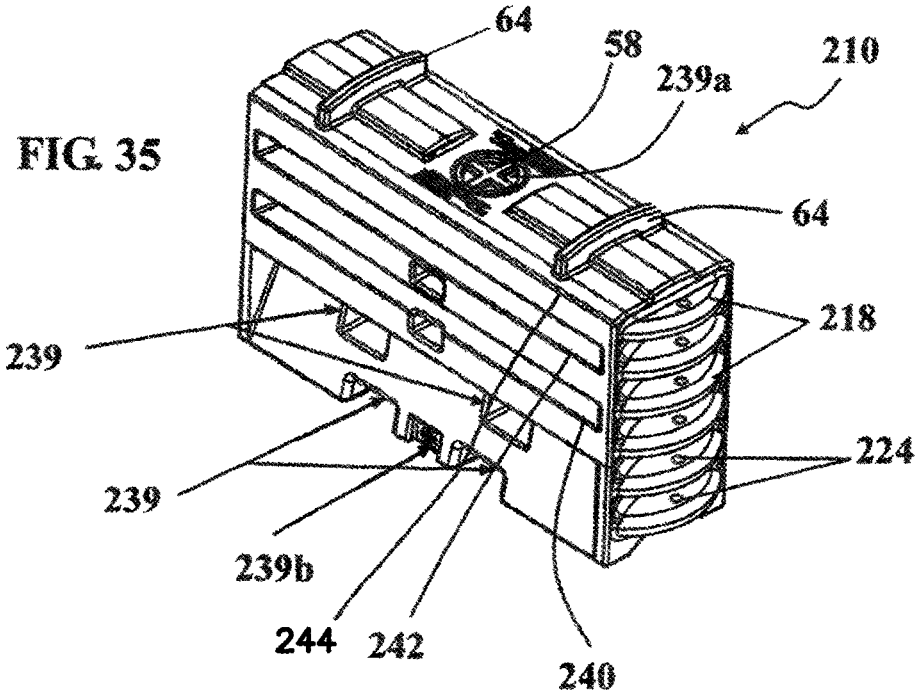
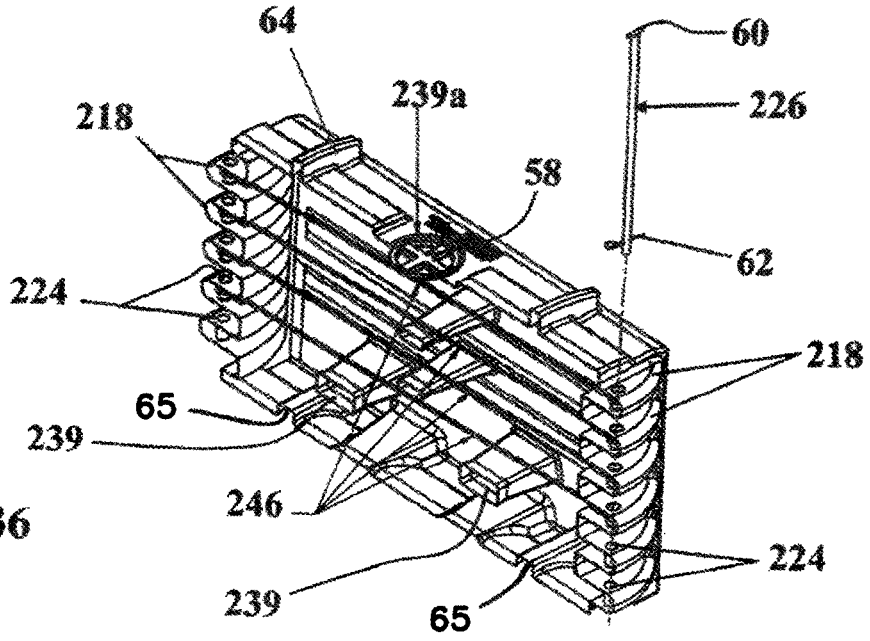
FIG. 36

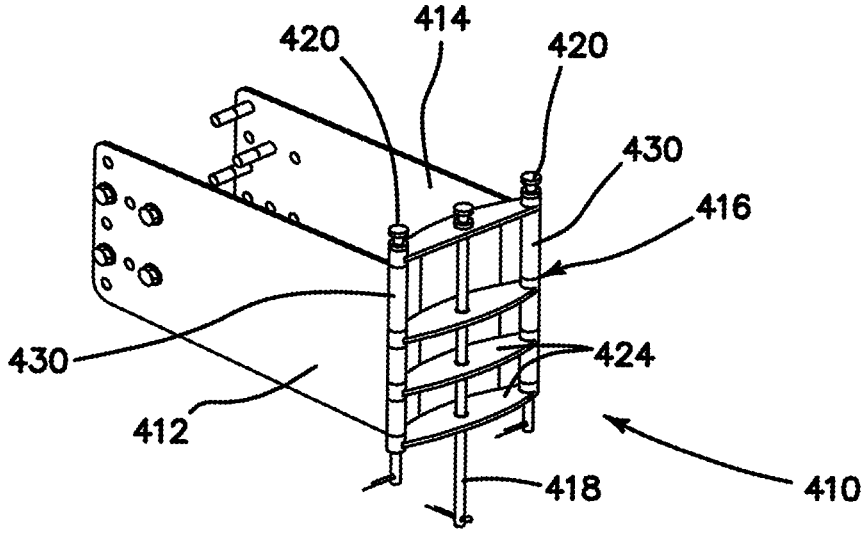
FIG. 63
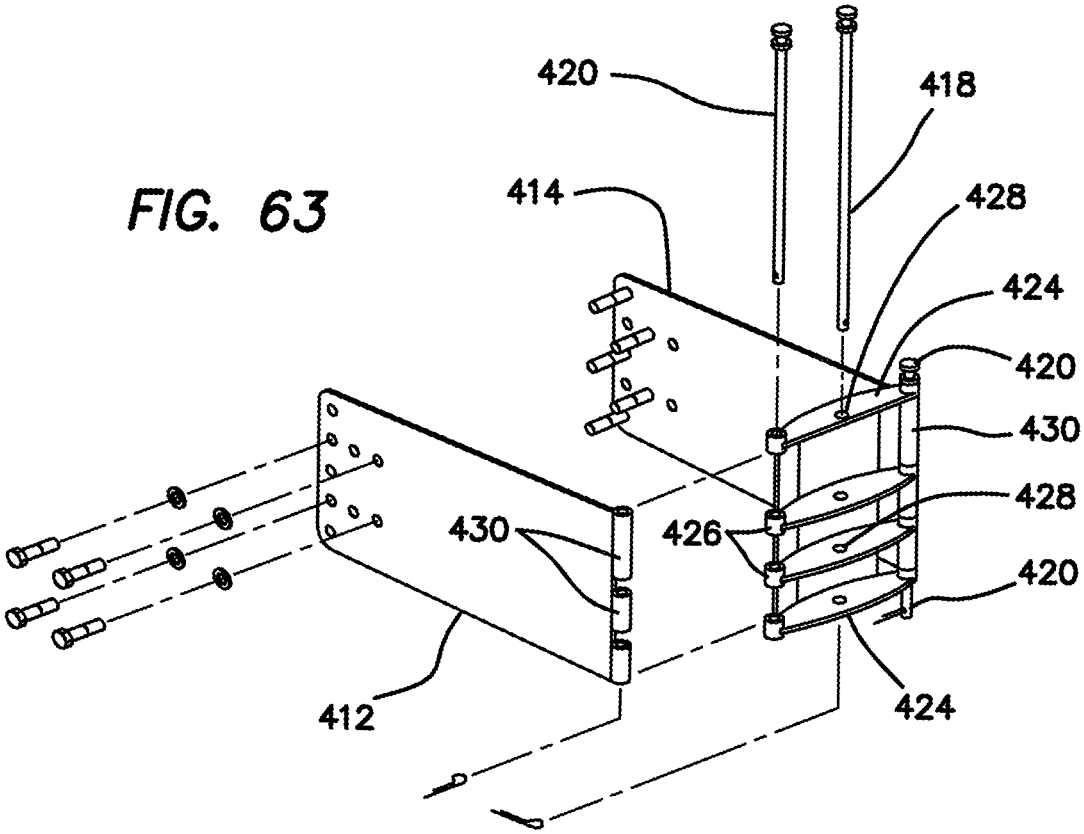

END TREATMENTS AND TRANSITIONS FOR WATER-BALLASTED PROTECTION BARRIER ARRAYS

This application is a divisional application under 35 U.S.C. 120 of U.S. application Ser. No. 13/371,269, entitled End Treatments and Transitions for Water-Ballasted Protection Barrier Arrays and filed on Feb. 10, 2012, now issued as U.S. Pat. No. 8,777,510 on Jul. 15, 2014, which in turn claims the benefit under 35 U.S.C. 119(e) of the filing date of Provisional U.S. Application Ser. No. 61/442,091, entitled End Treatments and Transitions for Water-Ballasted Protection Barrier Arrays, filed on Feb. 11, 2011. This application is also related to U.S. application Ser. No. 12/699,770, entitled Water-Ballasted Protection Barriers and Methods, filed on Feb. 3, 2010. All of the foregoing prior applications are commonly assigned with this one, and herein expressly incorporated by reference, in their entirety.

BACKGROUND OF THE INVENTION

The present invention relates generally to vehicle protection barriers, and more particularly to movable water ballasted vehicle traffic protection barriers for applications such as pedestrian protection, traffic work zone separation, airport runway divisions, and industrial commercial uses.

SUMMARY OF THE INVENTION

The present invention comprises an end treatment array for attenuating the forces generated by a vehicular impact. The inventive end treatment array include a transition barrier module comprising first and second side walls, first and second end walls, a top wall, and a bottom wall, wherein the module walls together define a substantially enclosed interior space. The transition barrier module has a predetermined width and length. The end treatment array advantageously further includes an innovative containment impact sled which comprises an axially extending frame. The frame has a width sufficient to contain the transition barrier module within the frame when in an assembled configuration, and has an axial length which is at least one-half the length of the transition barrier module. The frame defines an interior volume, the purpose of which is to contain a substantial portion of the transition barrier module in the assembled configuration, and to contain debris caused by destruction of the plastic barrier modules in a vehicular impact. The containment impact sled is attached to the transition barrier module in the aforementioned assembled configuration.

As noted above, the transition barrier module is fabricated of plastic. Importantly, the interior space is hollow and, unlike the regular barrier modules, is unfilled with any ballasting material for maximum initial energy absorption. The containment impact sled further comprises an upright wall connected to the frame which substantially covers the first front-facing end wall of the transition barrier module when the sled is in its assembled configuration, with the transition barrier module at least partially contained within the frame of the sled. The containment impact sled further comprises a floor.

The containment impact sled frame comprises a first side frame member attached to one side of the floor and upright wall and a second side frame member attached to an opposing side of the floor and the upright wall. Each of the side frame members comprise a bottom frame member and a top frame member, wherein the bottom frame member is disposed substantially horizontally, and the top frame member extends downwardly at an angle from its frontmost end to its rearmost end, with the frontmost end of the top frame member being connected to the upright wall near a top of the upright wall and the rearmost end of the top frame member being connected to a rearmost end of the bottom frame member near ground level, such that each side frame member is triangular in shape.

Apertures are provided in each of the transition barrier module and the sled, which are aligned when the transition barrier module and the sled are in the assembled configuration. A pin extends through the aligned apertures in the assembled configuration to attach the transition barrier module to the sled. The transition barrier module comprises a plurality of vertically spaced lugs on the first end wall, wherein each of the lugs have one of the apertures therein for receiving the pin. Additionally, one of the apertures is disposed in the upright wall of the sled.

Preferably, the transition barrier module comprises holes in a lower end thereof to prevent the containment of ballasting material in the interior space.

The end treatment array further comprises a plurality of vertically spaced lugs on the second transition barrier module end wall, for attaching the transition barrier module to a first end of an adjacent barrier module. In certain arrays, the adjacent barrier module is also a transition barrier module, constructed similarly to the first transition barrier module, and is also unfilled with ballasting material. The array further comprises a barrier module connected at a first end to the transition barrier module which is filled with a ballasting material, which is preferably water.

It should be noted that it is within the scope of the present invention to employ any number of transition barrier modules and any number of ballasted barrier modules in the array, depending upon desired crash attenuation characteristics and particular roadway conditions. So, the use of the term "connected" or "attached" herein does not necessarily mean a direct connection or attachment, but could mean an indirect connection through intermediate modules, unless specific language used requires otherwise. Importantly, for ease of assembly by on-site personnel, the transition barrier modules and the ballast-filled barrier modules are differently colored.

Another important aspect of the present invention is that the end treatment array comprises a second transition barrier module connected at a first end thereof to a second end of the barrier module, wherein the second transition barrier module is constructed substantially similarly to the first transition barrier module and is unfilled with ballasting material. This second end of the end treatment array is adapted for attachment to the fixed structure, such as a concrete abutment, which is being protected. Thus, end treatment hardware is provided for attaching a second end of the second transition barrier module to the fixed structure. The end treatment hardware, in disclosed embodiments, comprises a metal frame which is securable to the second end of the second transition barrier module. The frame comprises a plurality of vertically spaced horizontal cross members, each of which has an aperture in a middle portion thereof for receiving a pin, wherein in an assembled state the apertures are aligned. Additional components of the end treatment hardware are first and second hinge posts disposed at opposing ends of each of the assembled vertically spaced horizontal cross members, a first hinge pin, a second hinge pin, a left panel, and a right panel. The left panel is pivotally securable to aligned first hinge posts using the first hinge pin and the right panel is pivotally securable to aligned second hinge posts using the second hinge pin, so that the left and right panels can be rotated to extend along a length of the fixed structure. Each of the left and right panels have apertures therein for receiving hardware to secure each panel to the fixed structure. A pin is provided for insertion into the aligned apertures on each of the plurality of vertically spaced horizontal cross members.

In another aspect of the invention, there is provided a containment impact sled for use in an end treatment array for attenuating the forces generated by a vehicular impact, which comprises a frame extending in an axial direction and comprising a first side frame member, a second side frame member spaced from the first side frame member, and an end frame member extending across a width of the frame and securing the first side frame member to the second side frame member. The frame members together define an interior space. The containment impact sled is adapted for attachment to an adjacent barrier module in an assembled end treatment array, in such a manner as to contain a substantial portion of the adjacent barrier module within the interior space when the end treatment array is assembled.

The frame further comprises a floor attached to and extending between each of the side frame members and the end frame member, and further comprises an upright wall attached to a front end of the end frame member. The upright wall comprises an end cap. Each of the side frame members comprise a bottom frame member and a top frame member, wherein the bottom frame member is disposed substantially horizontally, and the top frame member extends downwardly at an angle from its frontmost end to its rearmost end, with the frontmost end of the top frame member being connected to the end frame member near a top of the end frame member and the rearmost end of the top frame member being connected to a rearmost end of the bottom frame member near ground level, such that each side frame member is triangular in shape.

An aperture is provided in the upright wall for attaching the containment impact sled to an adjacent barrier module. The frame is preferably comprised of metal, though it wouldn't necessarily have to be, if another suitably durable material were available.

In yet another aspect of the invention, there is disclosed a method of assembling an end treatment array for protecting a fixed structure from an impact by a passing vehicle. The method comprises steps of securing a plurality of ballast-filled hollow plastic barrier modules together in an axial array and securing one end of a transition barrier module to one end of the array of ballast-filled hollow plastic barrier modules. The transition barrier module is unfilled with ballasting material. A further method step is to secure a containment impact sled to the other end of the transition barrier module, wherein the containment impact sled comprises a frame defining an interior space, and wherein the securing step includes disposing the frame about the transition barrier module so that a substantial portion of the transition barrier module is contained within the interior space.

The securing step further comprises inserting a pin through aligned holes in both the containment impact sled and the transition barrier module and a step of securing a second transition barrier module to a second end of the axial array of ballast-filled barrier modules, wherein the second transition barrier module is unfilled with ballasting material. Additionally, the method comprises a step of securing the second transition barrier module to the fixed structure, using end treatment hardware comprising metal cross-members attached to the second transition barrier module and metal plates pivotally mounted to the metal cross-members.

The invention, together with additional features and advantages thereof, may best be understood by reference to the following description taken in conjunction with the accompanying illustrative drawings.

BRIEF DESCRIPTION OF THE DRAWINGS

FIG. 1 is an end elevation view showing a configuration of a water barrier segment or module constructed in accordance with one embodiment of the present invention;

FIG. 2 is a perspective view of a portion of the barrier module of FIG. 1;

FIG. 3 is a perspective view of the barrier module of FIGS. 1 and 2;

FIG. 4 is a front elevation view of the barrier module of FIG. 3;

FIG. 5 is a left end elevation view of the barrier module of FIGS. 1-4;

FIG. 6 is a right end elevation view of the barrier module of FIGS. 1-4

FIG. 12 is a plan view from the top showing two connected barrier modules rotating with respect to one another upon vehicular impact;

FIG. 13 is a cross-sectional plan view taken along lines A-A of FIG. 8, after vehicular impact and relative rotation of the two barrier modules;

FIG. 14 is a cross-sectional plan view of the detail section C of FIG. 13;

FIG. 15 is an elevation view of a barrier module of the type shown in FIG. 7, showing some of the constructional details of the module;

FIG. 16 is a top plan view of the barrier module of FIG. 15;

FIG. 17 is an end elevation view of the barrier module of FIG. 15;

FIG. 18 is a perspective view showing three barrier modules secured together;

FIG. 19 is a perspective view of a second, presently preferred embodiment of a barrier module constructed in accordance with the principles of the present invention;

FIG. 20 is a front elevation view of the barrier module shown in FIG. 19;

FIG. 21 is an end elevation view of the barrier module shown in FIGS. 19-20;

FIG. 22 is a top plan view of the barrier module shown in FIGS. 19-21;

FIG. 23 is a perspective view of the barrier module shown in FIGS. 19-22, taken from an opposing orientation;

FIG. 24 is an end elevation view of the barrier module of FIG. 23;

FIG. 25 is a sectioned perspective view of the barrier module of FIG. 23, showing internal constructional features of the barrier module, and in particular a unique cable reinforcement system;

FIG. 26 is a front sectioned view of the barrier module of FIG. 25;

FIG. 27 is a sectioned detail view of the portion of FIG. 26 identified as detail A;

FIG. 35 is an isometric view of another modified embodiment of a fluid-ballasted barrier module constructed in accordance with the present invention;

FIG. 36 is a cross-sectional isometric view taken along lines A-A of FIG. 35, illustrating certain interior features of the barrier module of FIG. 35;

FIG. 63 is an exploded isometric view of the end treatment hardware for use in the present invention.

DESCRIPTION OF THE PREFERRED EMBODIMENT

Figure 7:
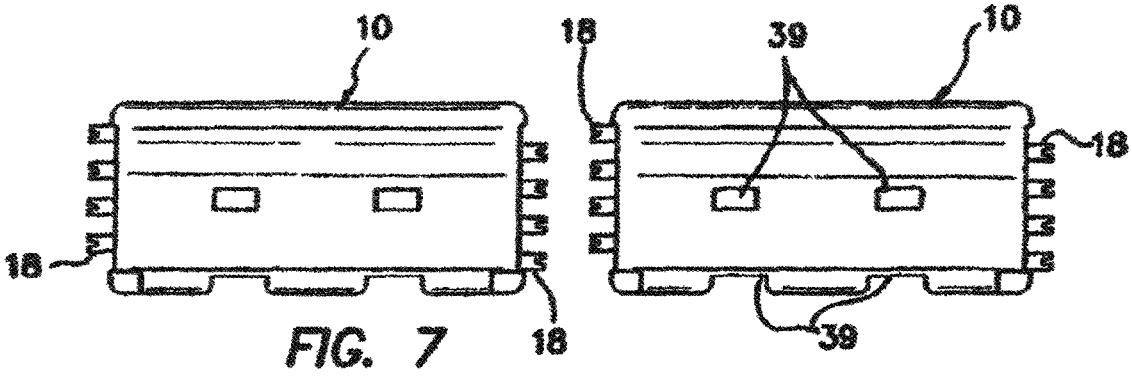
FIG. 7 is a front elevation view showing two barrier module such as that shown in FIG. 4, wherein the modules are detached.

Referring now more particularly to the drawings, there is shown in FIGS. 1-3 and 15-17 a water-ballasted barrier segment or module 10 constructed in accordance with one embodiment of the present invention. The illustrated barrier module preferably has dimensions of approximately 18 in. W×32 in. H×78 in. L, with a material thickness of about ¼ in. The material used to fabricate the module 10 may be a linear medium density polyethylene, and is preferably rotationally molded, although it may also be molded using other methods, such as blow molding. The module 10 preferably has an empty weight of approximately 75-80 lb., and a filled weight (when filled with water ballast) of approximately 1100 lb.

Particularly with respect to FIGS. 1-2, the barrier module 10 has been constructed using a unique concave redirective design, wherein outer walls 12 of the barrier module 10 are configured in a concave manner, as shown. In a preferred configuration, the concave section is approximately 71 inches long, and runs the entire length of the barrier module. The concave section is designed to minimize the tire of a vehicle, impacting the barrier along the direction of arrow 14, from climbing up the side of the barrier module, by pocketing the tire in the curved center portion of the barrier wall 12. When the vehicle tire is captured and pocketed inside the curved portion, the reaction force of the impact then diverges the vehicle in a downward direction, as shown by arrow 16 in FIG. 1. The concave diverging design will thus assist in forcing the vehicle back toward the ground rather than up the side of the water barrier module 10. In a preferred configuration, as shown in FIG. 1, the concave center portion of the outer wall 12 has a curve radius of approximately 24¾ in., and is about 23 inches in height.

FIGS. 3-11 illustrate an interlocking knuckle design for securing adjacent barrier modules 10 together. The interlocking knuckle design is a lug pin connection system, comprising four lugs 18 disposed in interweaved fashion on each end of the barrier module 10. Each lug 18 is preferably about 8 inches in diameter, and approximately 2 inches thick, although various dimensions would be suitable for the inventive purpose. To achieve the interweaved effect, on a first end 20 of the barrier module 10, the first lug 18 is disposed 4 inches from the top of the module 10. The remaining three lugs 18 are equally spaced vertically approximately 3½ inches apart. On a second end 22 of the barrier module 10, the first lug 18 is disposed about 7 inches from the top of the barrier module 10, with the remaining three lugs 18 being again equally spaced vertically approximately 3½ inches apart. These dimensions are preferred, but again, may be varied within the scope of the present invention.

Figure 8:
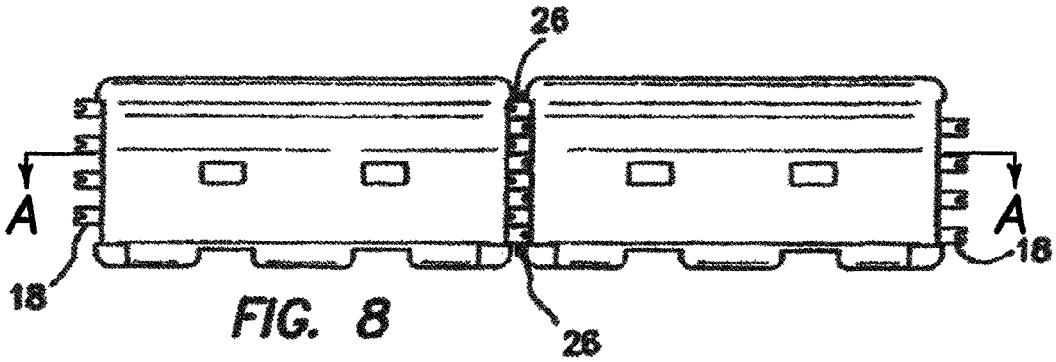
FIG. 8 is a front elevation view similar to FIG. 7, showing the barrier modules after they have been attached to one another.
Figure 10:
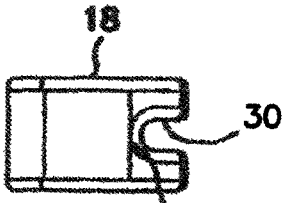
FIG. 10 is a cross-sectional view showing a double wall reinforcement area for a pin lug on the barrier module.
Figure 9:
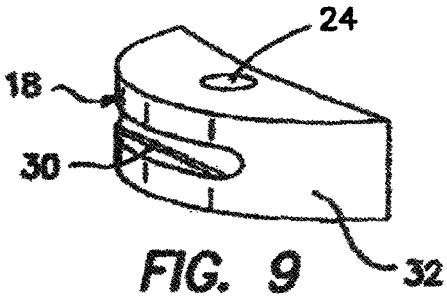
FIG. 9 is a perspective view, in isolation, of an interlocking knuckle for use in attaching two barrier modules together.
Figure 11:
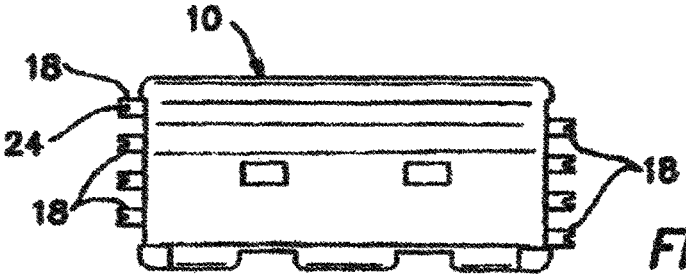
FIG. 11 is a front elevation view similar to FIG. 7 showing a barrier module.

When the ends of two adjacent barrier modules 10 are placed together, as shown sequentially in FIGS. 7 and 8, the complementary lugs 18 on the mating ends of the adjoined modules 10 slide between one another in interweaved fashion, due to the offset distance of each lug location, as described above, and shown in FIGS. 4 and 7. The lugs' dimensional offset permit each module 10 to be linked together with one lug atop an adjacent lug. This results in a total of eight lugs on each end of the water barrier module 10 that lock together, as seen in FIG. 8. Each lug 18 has a pin receiving hole 24 disposed therein, as best shown in FIGS. 9 and 10. When the eight lugs 18 are engaged, as discussed above, upon the adjoining of two adjacent barrier modules 10, these pin receiving holes 24, which are preferably approximately 1½ inches in diameter, and are disposed through the two inch thick portion of the lug 18, correspond to one another. Thus, a T-pin 26 is slid vertically downwardly through the corresponding pin receiving holes 24 of all eight lugs or knuckles 18, as shown in FIG. 8, in order to lock the two adjoined barrier modules 10 together.

To reduce the bearing load on the pin lug connection, a double wall reinforcement 28 may be included on the backside of the hole 24 on the lug 18, as shown in FIG. 10. The double reinforced wall is created by molding an indentation 30 on an outer curved section 32 of the lug 18, as shown in FIG. 9. The removal of material on the outside curved section 32 of the lug 18 creates a double reinforced wall on the inside section of the lug. The wall created by the recessed section 30 on the outside of the lug creates a reinforcement section 28 against the vertical hole 24 in the lug 18, as shown in sectioned FIG. 10. By creating this double wall reinforcement section 28, the T-pin 26 has two approximately ¼ inch thick surfaces to transfer the load to the T-pin 26 during vehicular impact. This arrangement will distribute the bearing load over a larger area, with thicker material and more strength.

During impact, the water barrier can rotate at the pin lug connection, resulting in large stresses at the pin lug connection during maximum rotation of the water wall upon impact. To reduce the stresses at the pin lug connection, a concave inward stress transfer zone is formed between the male protruding lugs 18, as shown in FIGS. 12-14. The concave inward section creates a concave female portion 34 at the ends of each water wall module where the male end of each lug 18 will slide inside when aligned, as illustrated. Before vehicular impact, the male lugs 18 are not in contact with any surface inside the concave female portion 34 of the barrier module 10. However, when the module 10 is impacted, and is displaced through its full range of rotation (approximately 30 degrees), as shown in the figures, the external curved surface of the male lugs will come into contact with the external surface of the inside wall of the concave female portion, as shown in FIG. 14. This transfers the load from the pin lug connection to the lug contact point of the male/female portion. By transferring the load of the vehicular impact from the pin lug connection to the female/male contact point, the load is distributed into the male/female surface contact point before the pin connection begins to absorb the load. This significantly reduces the load on the T-pin 26, minimizing the pin's tendency to bend and deform during the impact.

To accommodate the ability to dispose a fence 36 or any other type of device to block the view or prevent access to the other side of the barrier 10, the t-pins 26 are designed to support a square or round tubular fence post 38, as shown in FIG. 18. The tubular post 38 is adapted to slip over the t-pin, with suitable retaining structure disposed to ensure that the post 38 is firmly retained thereon.

In a preferred method, each barrier module 10 is placed at a desired location while empty, and relatively light. This placement may be accomplished using a forklift, for example, utilizing forklift apertures 39. Once the modules are in place, and connected as described above, they can then be filled with water, using fill apertures 39*a* as shown in FIG. 3. When it is desired to drain a barrier module, drain apertures, such as aperture 39*b* in FIG. 15, may be utilized.

Now referring in particular to FIGS. 19-21, a second embodiment of a water-ballasted barrier module 110 is illustrated, wherein like elements are designated by like reference numerals, preceded by the numeral 1. This barrier module 110 is preferably constructed to have overall dimensions of approximately 22 in. W×42 in. H×78 in. L, with a material thickness of about ¼ inches. As in the prior embodiment, these dimensions are presently preferred, but not required, and may be varied in accordance with ordinary design considerations. The material of which the barrier module 110 is fabricated is preferably a high density polyethylene, and the preferred manufacturing process is rotational molding, although other known processes, such as blow molding, may be used.

The illustrated embodiment utilizes a unique configuration to minimize that chances that an impacting vehicle will drive up and over the module 110 upon impact. This configuration comprises a saw tooth profile, as illustrated, which is designed into the top portion of the barrier module 110, as shown in FIGS. 19-24. The design intent of the saw tooth profile is to snag the bumper, wheel, or any portion of a vehicle impacting the barrier 110 from a direction indicated by arrow 114 (FIG. 23) and to deflect the vehicle in a downward direction as indicated by arrow 116 (FIG. 23). The saw tooth profile shape runs the entire length of each section of the barrier module 110, as shown. A first protruding module or sawtooth 40, forming the sawtooth profile, begins to protrude approximately 20 inches above the ground, and second and third protruding modules 42, 44, respectively are disposed above the module 40, as shown. Of course, more or fewer sawtooth modules, or anti-climbing ribs, may be utilized, depending upon particular design considerations. The design intent of using a plurality of sawtooth modules is that, if the first anti-climbing rib 40 does not succeed in containing the vehicle and re-directing it downwardly to the ground, the second or third climbing ribs 42, 44, respectively, should contain the vehicle before it can successfully climb over the barrier 110.

The first embodiment of the invention, illustrated in FIGS. 1-18, is capable of meeting the earlier described TL-1 crash test, but plastic construction alone has been found to be insufficient for withstanding the impact of a vehicle traveling 70 kph or 100 kph, respectively, as required under TL-2 and TL-3 testing regimes. The plastic does not have sufficient physical properties alone to stay together, pocket, or re-direct an impacting vehicle at this velocity. In order to absorb the energy of a vehicle traveling at 70 to 100 kph, the inventors have found that steel components need to be incorporated into the water barrier system design. Using steel combined with a large volume of water for ballast and energy absorption enables the properly designed plastic wall to absorb the necessary energy to meet the federal TL-2 and TL-3 test requirements at such an impact.

To contain the 70 to 100 kph impacting vehicle, the inventors have used the interlocking plastic knuckle design described earlier in connection with the TL-1 water barrier system described and shown in FIGS. 1-18 of this application. The same type of design principles are used in connection with this larger and heavier TL-2 and TL-3 water barrier system, which includes the same interlocking knuckle attachment system disclosed in connection with the first embodiment.

The TL-2 and TL-3 barrier system described herein in connection with FIGS. 19-31 absorbs energy by plastic deformation, water displacement, wire rope cable fencing tensioning, water dissipation, and overall displacement of the water barrier itself. Since it is known that plastic alone cannot withstand the stringent test requirements of the 70-100 kph TL-2 and TL-3 vehicular impact protocols, internally molded into the barrier module 110 is a wire rope cable 46, which is used to create a submerged fence inside the water barrier module 110 as shown in FIGS. 25 and 26. Before the barrier module 110 is molded, the wire rope cables 46 are placed inside the mold tool. The cables are made with an eyelet or loop 48 (FIG. 30) at each end, and are placed in the mold so that the cable loops 48 wrap around the t-pin hole 124 outside diameter as shown in FIG. 27. Preferably, the wire rope cables 46 are each comprised of stainless steel, or galvanized and stranded steel wire cable to resist corrosion due to their contact with the water ballast, and are preferably formed of ⅜ inch 7×19 strands, though alternative suitable cable strands may be used as well. By placing the cables 46 around the t-pin holes 124, dual fence posts are created on each side of the barrier module 110, with four cable lines 46 disposed in between, thereby forming an impenetrable cable fence in addition to the water ballast. It is noted that the wire cable loop ends are completely covered in plastic during the rotational molding process, to prevent water leakage.

Figure 28:
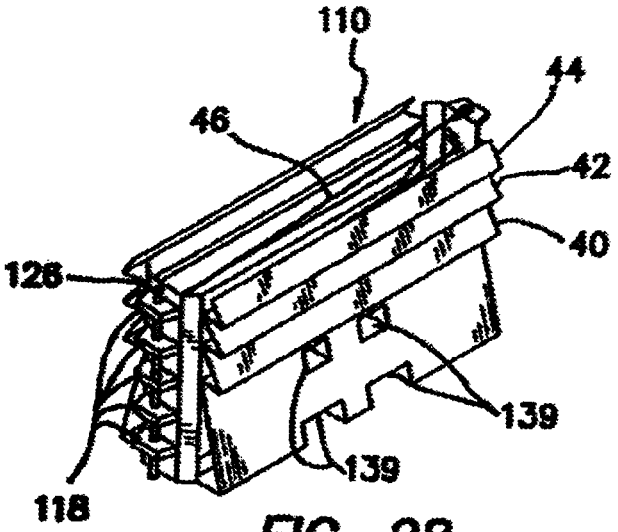
FIG. 28 is a perspective view of the barrier module of FIGS. 19-27.
Figure 30:
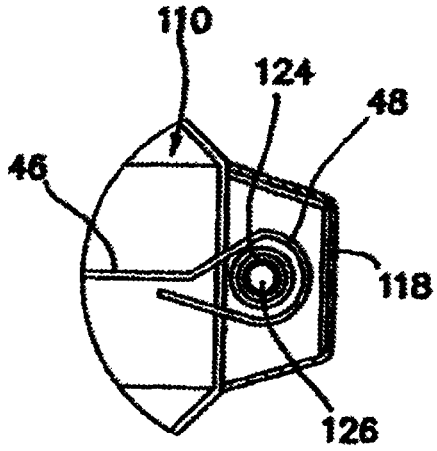
FIG. 30 is a sectioned detail view of the portion of FIG. 29 identified as detail A.
Figure 29:
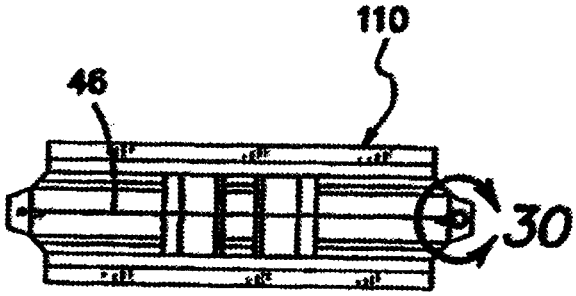
FIG. 29 is a top plan view of the barrier module of FIG. 28.

By placing the wire rope cable 46 and wrapping it around the t-pin hole 124, a high strength area in the interlocking knuckles is created. When the t-pin 126 is dropped into the hole 124, to connect a series of barrier fence modules 110, it automatically becomes a steel post by default, since the wire rope cable modules 46 are already molded into the barrier modules. Since the loop of each cable end wraps around the t-pin in each knuckle, the impacting vehicle will have to break the wire rope cable 46, t-pin 126, and knuckle in order to break the barrier. FIGS. 28-30 illustrate how the wire rope cables 46 wrap the T-pin holes 124.

Figure 31:
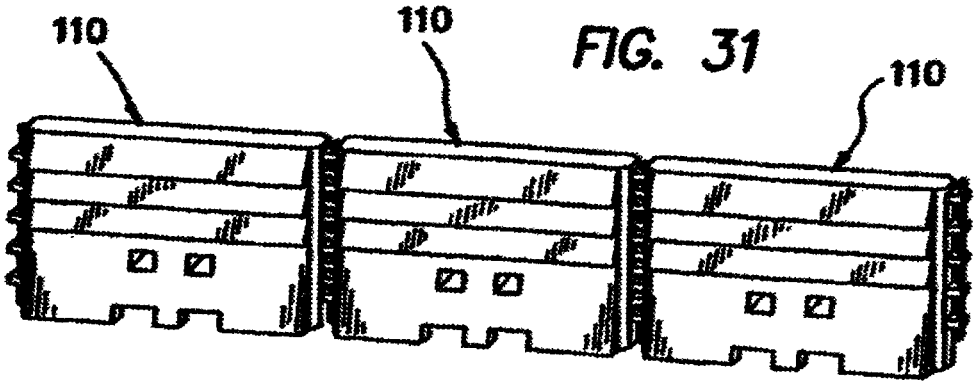
FIG. 31 is a perspective view showing three barrier modules secured together.

The wire rope cables 46 are an integral part of each barrier module 110, and cannot be inadvertently omitted or removed once the part has been manufactured. The current design uses up to four wire rope cables 46 per barrier module 110, as illustrated. This creates an eleven piece interlocking knuckle section. More or fewer knuckles and wire rope cables may be utilized, depending upon whether a lower or taller barrier is desired. The wire rope fence construction disclosed in connection with this second TL-2 or TL-3 embodiment can also be incorporated into the lower height barrier illustrated and described in FIGS. 1-18. When large numbers of barrier modules are used to create a longitudinal barrier, a wire rope cable fence is formed, with a t-pin post, with the whole assembly being ballasted by water without seeing the cable fencing. FIG. 31 illustrates such a plurality of modules 110, interlocked together to form a barrier as just described. As illustrated, each barrier module is approximately 2100 lb when filled with water.

As the barrier illustrated in FIG. 31 is impacted by a vehicle, the plastic begins to deform and break, the barrier wall in the impact zone begins to slide, further absorbing energy, water ballast is displaced, and water is dispersed while the wire rope cables 46 continue the work of absorbing the impact energy by pulling along the knuckles and placing the series of wire rope cables in tension within the impact zone. The entire area of impact immediately becomes a wire rope cable fence in tension, holding the impacting vehicle on one side of the water ballasted barrier. Otherwise, the normal status of the barrier is for the wire rope cables 46 to be in a slack state. The excellent energy absorption of this system is enhanced by the progressive nature of the events that occur, in sequence, as described above, resulting in a progressive deceleration of the vehicle and full absorption of the impact energy with minimum harm to vehicle occupants and nearby vehicles, pedestrians, and structures.

Figure 32:
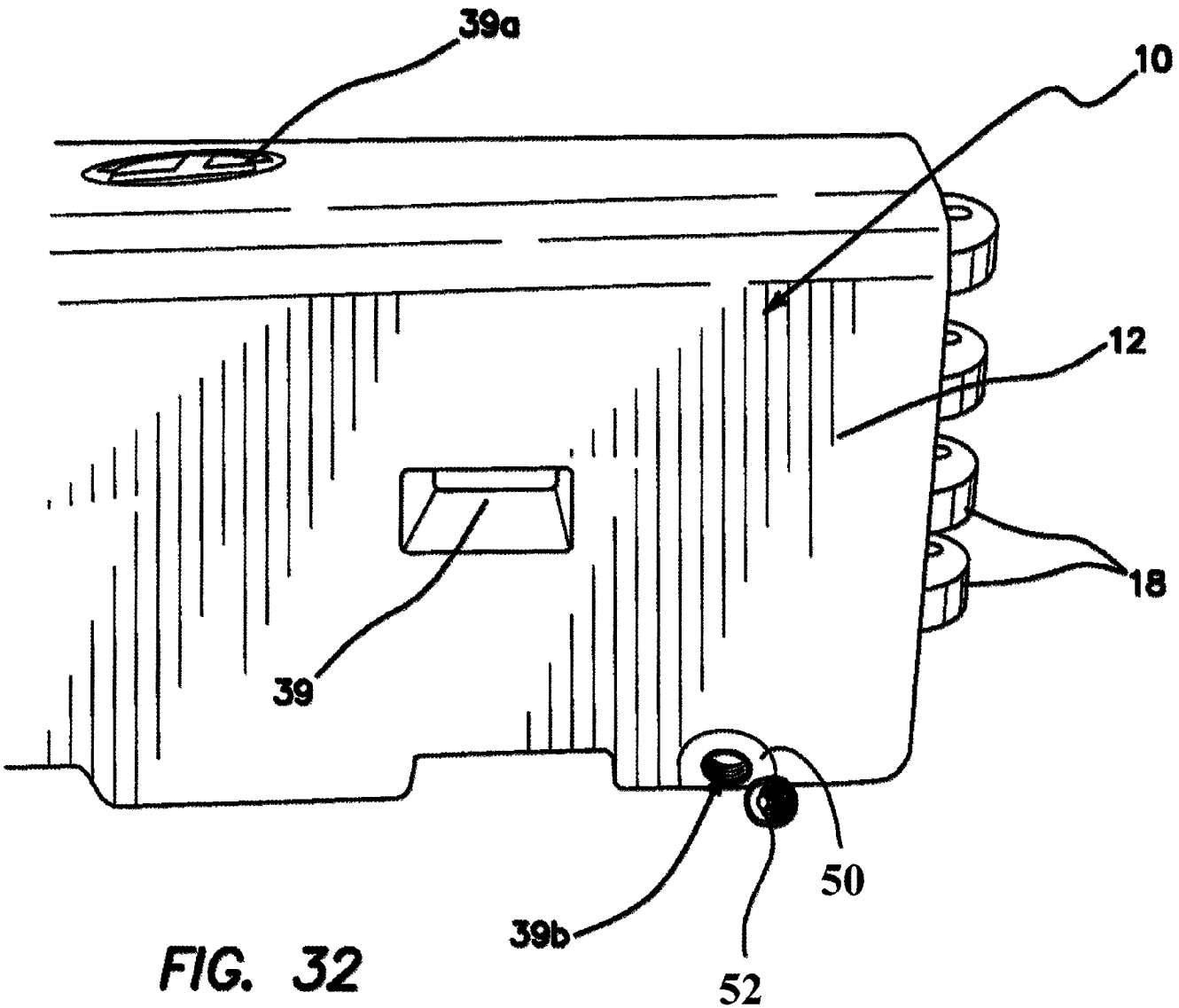
FIG. 32 is a front elevation view of a barrier module constructed in accordance with the principles of the invention, in which is disposed a drain aperture having an inventive buttress thread configuration.
Figure 33:
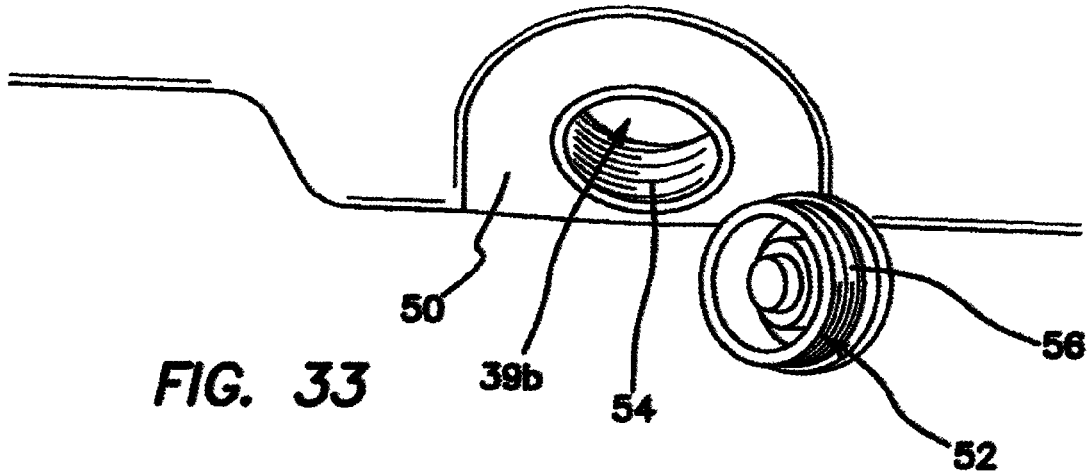
FIG. 33 is an enlarged view of the drain aperture of FIG. 32.
Figure 34:
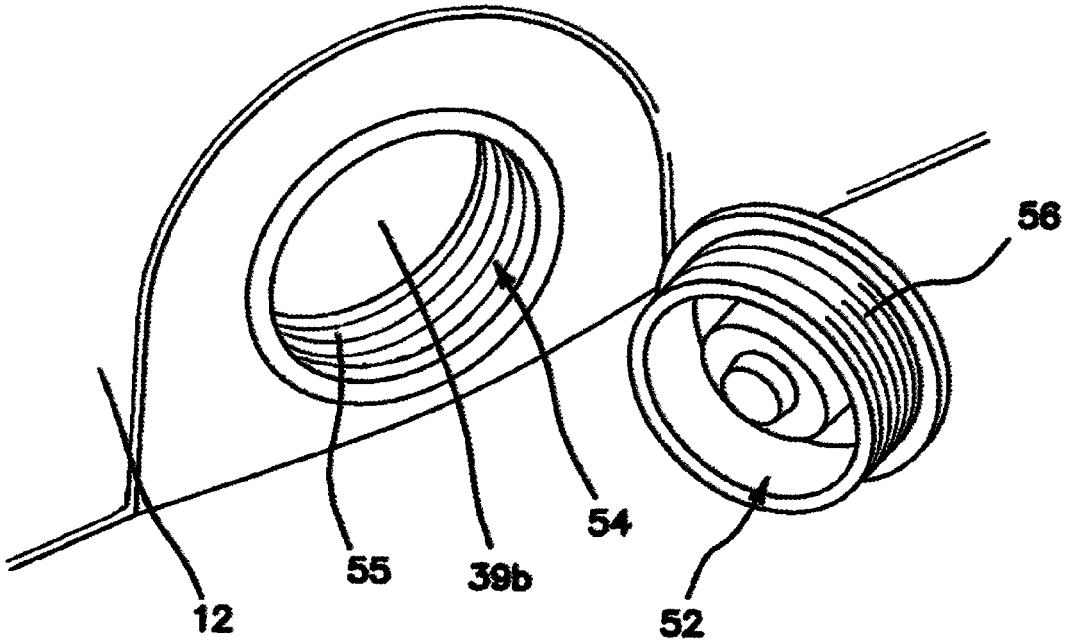
FIG. 34 is an enlarged perspective view of the drain aperture of FIG. 32.
Figure 37:
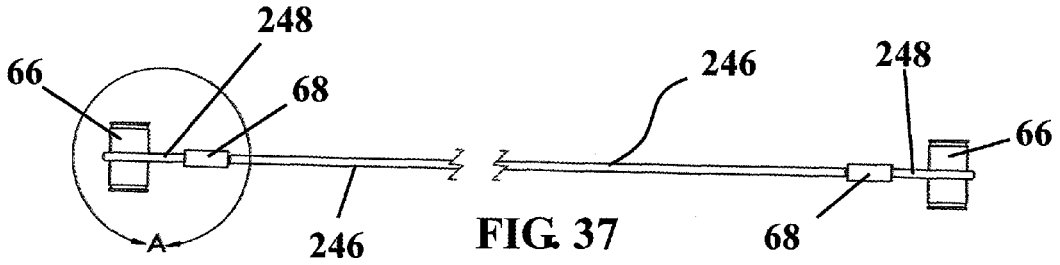
FIG. 37 is a plan view illustrating the construction of a presently preferred configuration for the wire rope assembly of the present invention, in isolation.

With reference particularly to FIGS. 32-34, an inventive embodiment of the drain aperture **39*b* will be more particularly described. This particular feature is applicable to any of the above described embodiments of the invention. The aperture 39*b* is disposed within a recess 50 in a bottom portion of the barrier module 10. A closure or cap 52 is provided for closing and sealing the aperture 39*b* to prevent leakage of ballast from the barrier module 10. The closure 52 is secured in place by means of a series of buttress threads 54 (FIGS. 33, 34). The buttress threads 54 are coarse and square cut, with flat edges 55, and advantageously function to create a hydraulic seal through the interference fit between the threads 54 on the aperture 39*b* and mating threads 56 on the closure 52. The closure 52 comprises, in the preferred embodiment, a plastic plug which is threaded into the barrier module outer wall 12 by means of the interengaging buttress threads 54, 56, as described above. A sealing washer on the plug 52 seats, in a flat profile, on the sealing surface on the barrier wall 12 once the threads are engaged and tightened. This flat profile results in a lower chance of leakage, with no need to over-tighten the plug 52. Advantageously, the unique design results in a much reduced chance of cross-threading the plug when threading it into the wall, compared with prior art approaches, and it is much easier to start the thread of the plug into the barrier wall. Because of the recess 50, the plug 52** is flush or even recessed relative to the wall, which reduces the chances of damage to the plug during use.

The thread 54 is uniquely cast-molded into the wall, which is typically roto-molded. Avoidance of spin-welding, which is a typical prior art technique for fabricating threads of this type in a roto-molded device, surprisingly greatly reduces the chance of damage to the barrier and closure due to cracking and stripping.

Referring now to FIGS. 35-41, yet another modified embodiment of the present invention is illustrated, wherein like elements to those in the previous embodiments are designated by like reference numerals, preceded by the numeral 2. Thus, in FIGS. 35 and 36 a barrier module 210 is shown, which is similar in many respects to barrier module 110, but differs in ways that will be described herein. The barrier module 210 comprises forklift and pallet jack lift points 239 disposed on a bottom edge of the module, as well as a second set of forklift lift points 239 disposed above the first set. A drain aperture **239*b* is disposed between the two lower lift points 239. The drain aperture preferably employs the cap and buttress thread features illustrated and described in connection with FIGS. 32-34. A fill aperture 239*a* is disposed on a top surface of the module, having a diameter, in one preferred embodiment, of approximately 8 inches. Advantageously, the fill aperture also comprises a lid 58, which is molded with fittings designed to ensure water-tight securement with an easy ¼ turn of the lid. As illustrated, each barrier module weighs approximately 160 lb when empty, and approximately 2000 lb when filled with approximately 220 gallons of water. The module 210** is approximately 72 inches in length (excluding the lugs), 46 inches in height, and 22 inches wide.

In the illustrated embodiment, the right side of each barrier module 210 preferably includes five lugs 218, while the left side comprises six lugs 218. These lugs are configured to be interleaved when two adjacent barrier modules 210 are joined, as in the prior embodiments, so that the pin receiving holes 224 are aligned for receiving a T-pin 226. The T-pin 226 comprises a T-pin handle 60 at its upper end, and a keeper pin 62 insertable through a hole in its lower end, as illustrated in FIG. 36. To join the barrier modules 210 together, the T-pin 226 is inserted downwardly through all of the aligned holes 224. Then, the keeper pin 62 is inserted through the hole in the lower end of the pin 226, to ensure that the T-pin cannot be inadvertently removed. In a preferred embodiment, the diameter of the T-pin is approximately 1¼".

Figure 42:
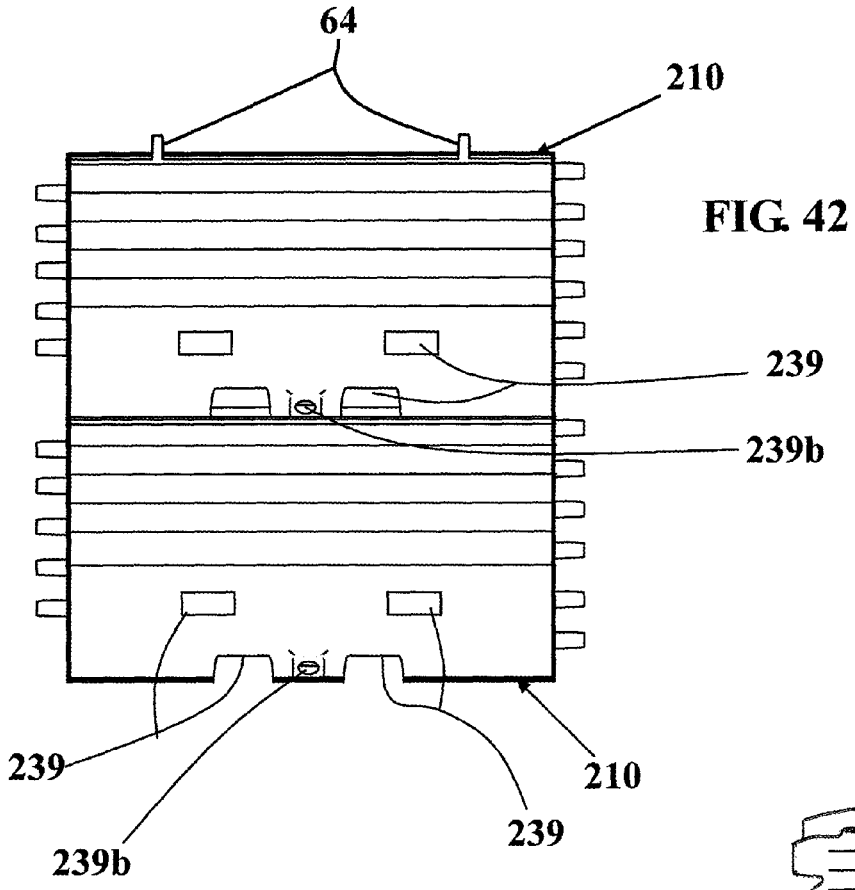
FIG. 42 is a plan view illustrating two of the barrier modules of the present invention in a vertically stacked configuration.
Figure 43:
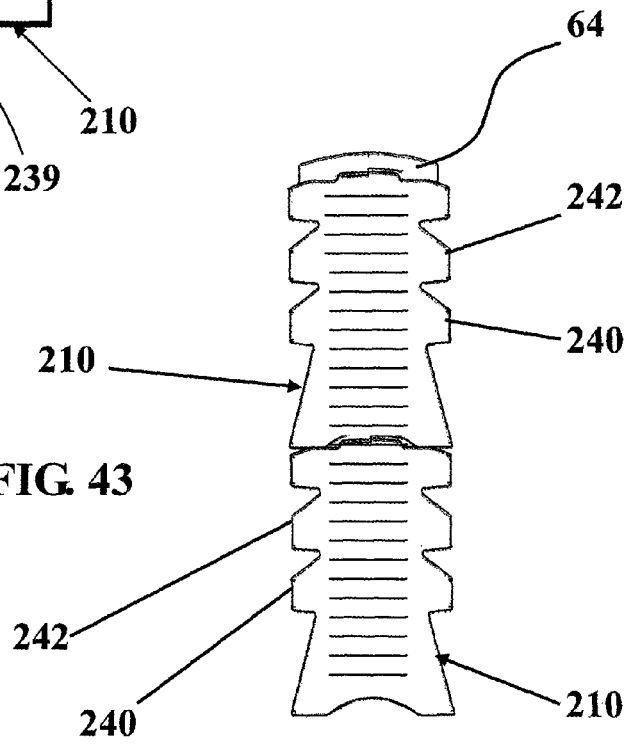
FIG. 43 is an end view of the stacked array of FIG. 42.

Stacking lugs 64 are disposed on the top surface of each barrier module, and corresponding molded recesses 65 are disposed in the lower surface of the barrier module 210. Thus, as shown in FIGS. 42 and 43, the barrier modules 210 may be stacked vertically, with the stacking lugs 64 on the lower barrier module 210 engaging with their counterpart stacking recesses 65 on the upper barrier module 210. Two barrier modules, stacked vertically, have a total height of approximately 87 inches, in one preferred embodiment.

One significant difference between the embodiment of FIGS. 19-31 and the embodiment of FIGS. 35-41 is the particular design of the sawtooth modules 240, 242, and 244. As is evident from inspection of the various figures, the latter embodiment retains substantially flat barrier side walls, with recesses into which the sawtooth modules extend, in an upward slanting direction, as shown. The resulting anti-climb function is similar to that of the FIGS. 19-31 embodiment, but the manufacturing process is greatly simplified. In one preferred embodiment, the angle of slant of each sawtooth module is approximate 43 degrees.

Now, with reference particularly to FIGS. 37-41, details of the innovative wire rope cable system are illustrated. In this embodiment, an insertion sleeve or bushing 66 is molded into each lug or knuckle 218, where a wire rope cable 246 is placed. The bushing 66 is preferably cylindrical, and its interior diameter comprises the pin receiving hole 224 of the corresponding knuckle 218 in which the bushing is molded. The bushing 66 is preferably comprised of steel, though other suitable materials may be employed. As in prior embodiments, the wire rope cables preferably comprise ⅜ inch 7×19 galvanized steel cable, though other suitable materials may also be utilized. Because of the advantageous molding techniques of the present invention, which causes the cable loops 248 to be completely encapsulated in molded plastic, stainless steel cables need not be used. The inventors have found that galvanized braided carbon steel cable is stronger. Both the bushing 66 and the cable 246 is preferably hot-dipped galvanized.

Figure 38:
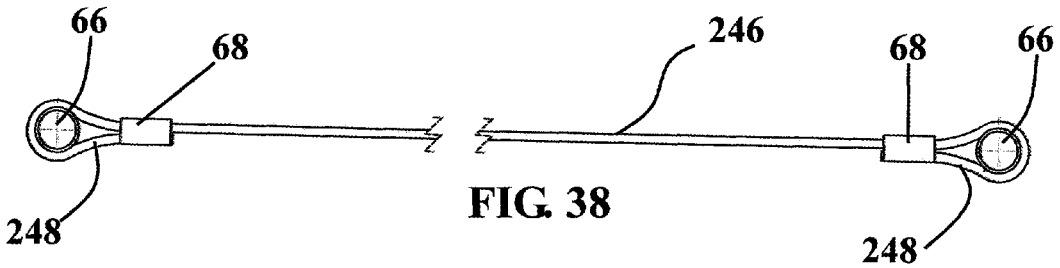
FIG. 38 is a top view of the assembly illustrated in FIG. 37.
Figure 39:
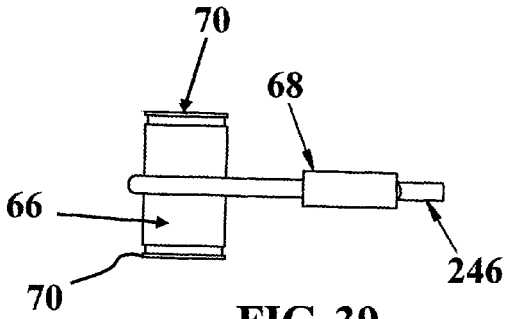
FIG. 39 is an enlarged view of the portion of FIG. 37 denoted by the circle A.
Figure 40:
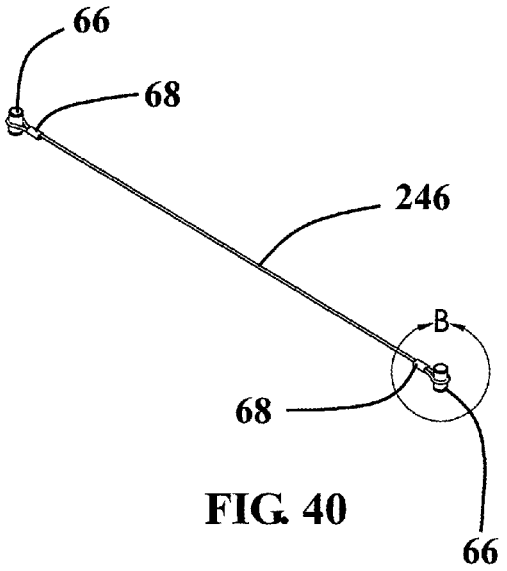
FIG. 40 is an isometric view of the assembly illustrated in FIGS. 37 and 38.
Figure 41:
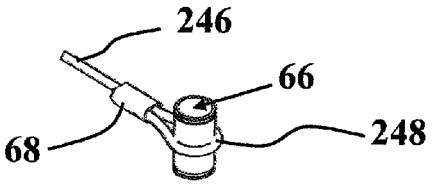
FIG. 41 is an enlarged isometric view of the portion of FIG. 40 denoted by the circle B.

Each end of the steel cable 246 is extended around the bushing 66 to form eyelet or loop 248, and secured to the remaining cable 246 by a swage or clamp 68. The bushing 66 is sized to allow it to be inserted into the mold prior to molding. The assembly illustrated in FIG. 38 is then placed in the barrier module mold (not shown), together with the other similar assemblies, preferably four in total, as shown in FIG. 36, so that corresponding knuckles 218 on each side of the barrier are tied together by a wire rope cable assembly 246. The cables are relatively taut when placed into the mold. When the rotational molding process is completed, including the cooling of the barrier module, the cables become slack. The amount of slack contributes to the effectiveness of the bushing-cable assembly during an impact by allowing the plastic and the water to absorb some of the impact energy before the cables are engaged. The bushing and a portion of the cable loop become encapsulated in plastic as a result of the molding process, forming an integrally molded-in, leak-proof connection.

In a preferred configuration, the bushing 66 comprises steps 70 at the top and bottom ends thereof. The bushing 66 is approximately 3⅛" in length, with a 1½" ID and a 1¾" OD. The steps 70 are preferably approximately 0.095 inches, and serve to create an edge for plastic to form an extra thick layer around the top and bottom sections of the bushing during the molding process. By creating the thicker plastic layer in these portions, the sleeve edge design inherently prevents water from leaking at these top and bottom edges. This thicker plastic layer prevents water seepage from occurring between the steel and plastic mating surfaces. The entire assembly of a wire rope cable 246 and, on each end, a clamped loop 248 and bushing 66 is approximately 77½" in length when taut, from the center of one bushing to the center of the other.

An actual vehicular impact produces the following energy absorbing actions:

1. One or more of the high density polyethylene (HDPE) barrier modules which are impacted, slide, deform from the impact, and finally burst;
2. The water in each burst section is released and dispersed over a wide area;
3. The cables 246 are engaged and prevent breaching or climbing by the impacting vehicle of the barrier;
4. Many modules 210 of the barrier remain assembled together, but are moved during the impact. They are either dragged closer to the point of impact if they are in tension, or pushed away if they are in compression.

It should be noted that relatively few barrier modules 210 will burst, depending upon the severity of the impact. Many modules will move and will remain undamaged, with a few having minor leaks which are readily repaired.

The bushing 66 serves several advantageous purposes. First, it is a significant contributor to the molding process, making it easier to manufacture and minimizes leaks when the barrier module 210 is completed during the molding process. Also, during impact, the bushing spreads the impact load that is transmitted from the steel cables 246 to the knuckles 218, and the load is further transferred to the connecting pin 226. This ensures that the assembled barrier, comprised of a plurality of modules which are joined together, as shown in FIGS. 7, 8, 12, 13, 18, and 31, for example, will not be breached during an impact. Moreover, the location of the cables 246 prevents a vehicle from climbing over the wall during an impact. Crash tests conducted on the inventive barrier system demonstrate that the displacement of barrier walls formed of assembled barrier modules 210, upon vehicular impact, are displaced significantly less than is the case with competing prior art products. This is a considerable advantage, in that clear space required behind the barrier can be substantially less, meaning that less roadway area requires closure.

It will also be noted, from review of the figures, that the knuckles 218 of this modified embodiment are differently constructed than those illustrated in the prior embodiments. In particular, in the prior embodiments, the knuckles do not extend substantially the full width of the barrier module. Rather, the outside radius of each knuckle meets a flat surface at the end of the barrier module, and the knuckle only extends about ¾ of the full width of the end wall. The flat surface then extends out to the outer profile of the module, creating the shape of the wall. Under certain conditions, this construction can cause tearing of the knuckles away from the end wall of the barrier module. Accordingly, the knuckles 218 in the embodiment of FIGS. 35-41 are designed to extend substantially the entire width of the barrier module, as shown, so that the knuckle radius meets the outer, lengthwise walls of the barrier module. This change surprisingly serves to significantly increase the strength of the walls of the barrier module.

Another modified embodiment of the inventive concept may comprise barrier modules 210, molded in 3 foot lengths, with lug connections and cables, as shown and discussed above, for the purpose of functioning as a barricade end treatment. In this embodiment, the T-pins 226 extend downwardly through the connection lugs 218 and bushings 66, to ground. Such a device comprises a non-gating device, because, with the cable connections, a vehicle cannot get through it. This embodiment may comprise a cast "New Jersey" barrier wall, wherein one end is squared off. In this embodiment, female sockets are molded internally on the squared-off end, and sized the same as the male lugs on the other end, so that they fit together for reception of a drop or T-pin. This embodiment results in a flush connection between two adjoining barricade modules 210, which means there is no surface interruption and no relative rotation between those barrier modules. As noted above, the T-pin extends to ground, and into a hole drilled into the ground, so that there is no wall translation, thus creating the non-gating barrier.

It is noted that there is no requirement that the barrier module 210 be ballasted with water. Alternative ballasts, particularly if dispersible, may be utilized. It is also within the scope of the invention, particularly if a particular module 210 is to be used as an end treatment, to fill the module with foam. The foam would be installed during the manufacturing process, and the fill and drain apertures could be eliminated. The cables 246 would still be used.

Figure 44:
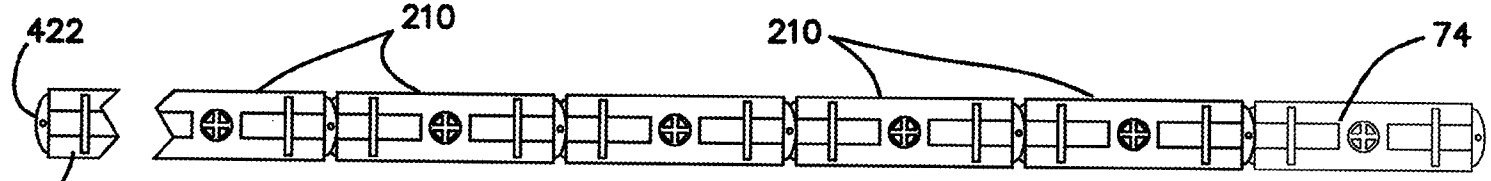
FIG. 44 is a top view of an end treatment array in accordance with the present invention.
Figure 45:
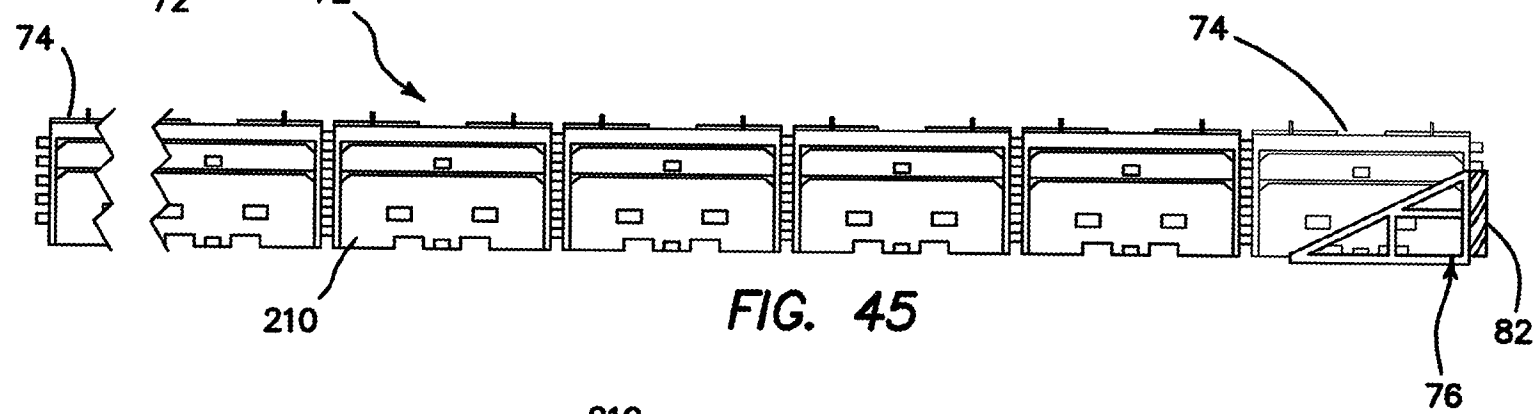
FIG. 45 is a plan view of the array of FIG. 44.
Figure 46:
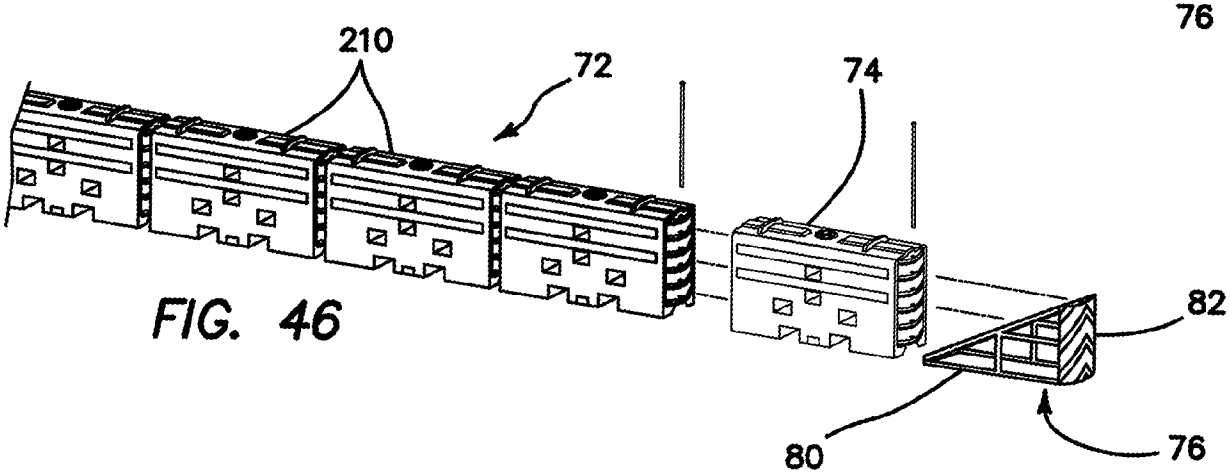
FIG. 46 is an isometric view of the array of FIGS. 44 and 45.
Figure 47:
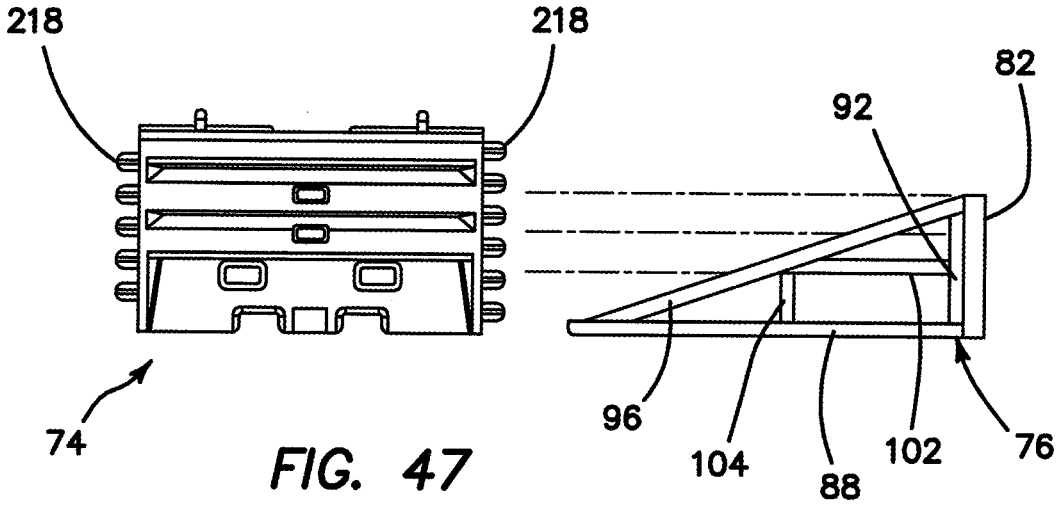
FIG. 47 is a plan view showing the left side of a transition barrier module and containment impact sled assembly in accordance with the present invention.
Figure 48:
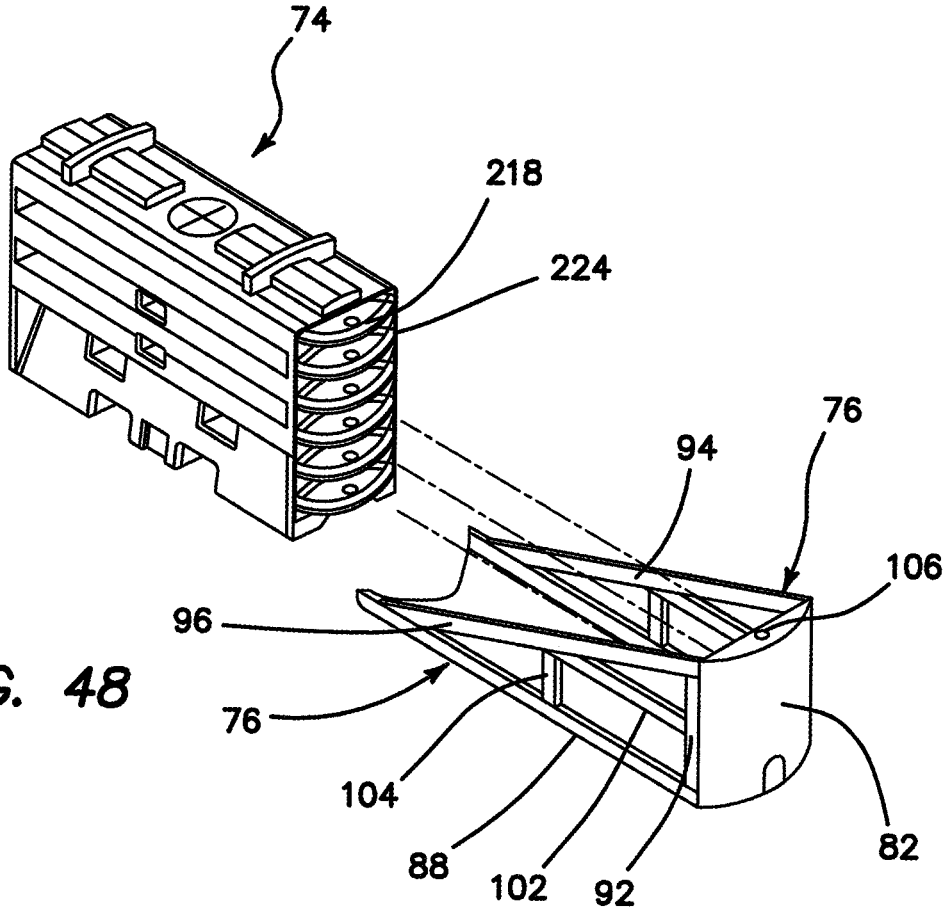
FIG. 48 is an isometric view of the structures shown in FIG. 47.
Figure 49:
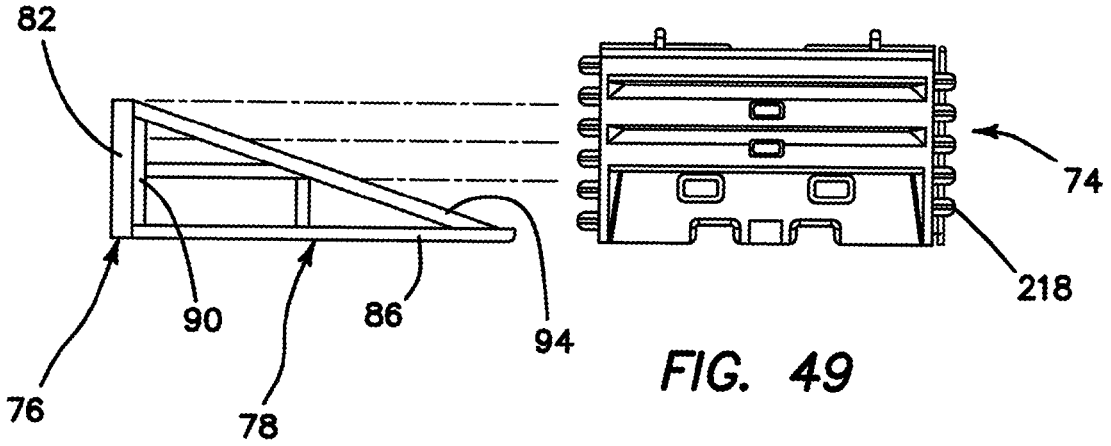
FIG. 49 is a plan view similar to FIG. 47 of the right side of a transition barrier module and containment impact sled assembly.
Figure 50:
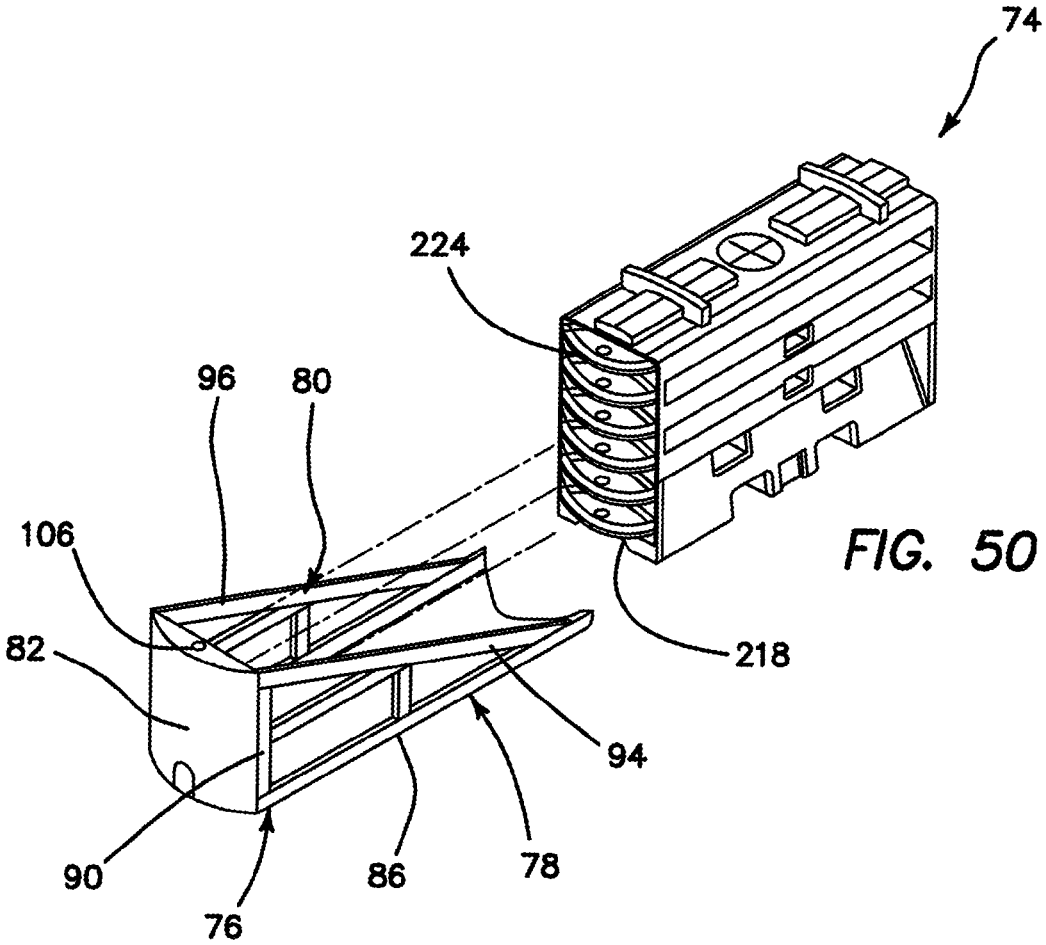
FIG. 50 is an isometric view of the structures shown in FIG. 49.
Figure 51:
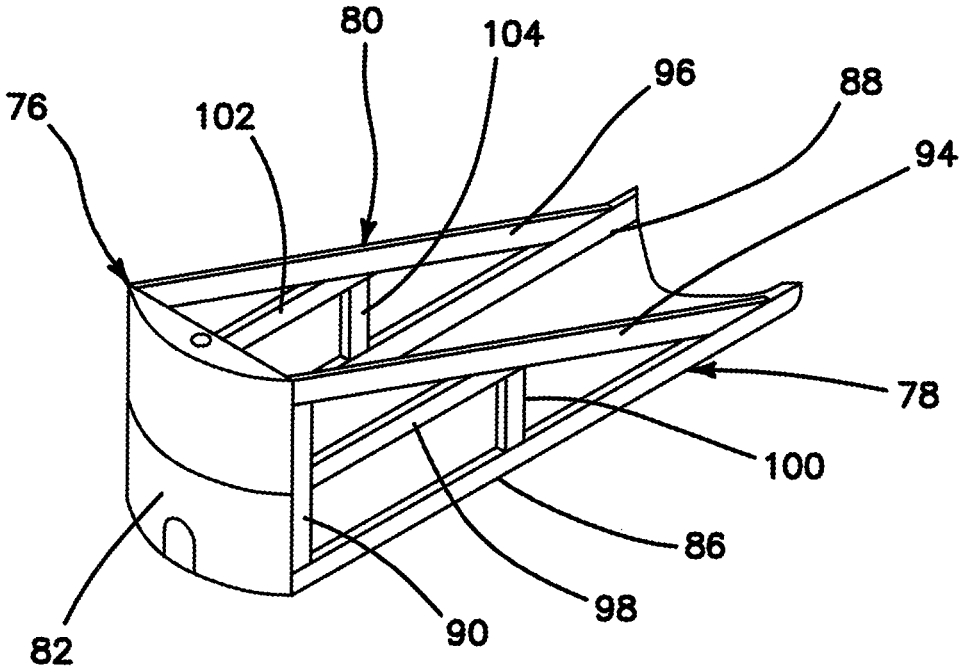
FIG. 51 is an isometric view of a containment impact sled in accordance with the present invention.

Now, with reference to FIGS. 44-46, there is illustrated an array 72 of barrier modules, such as barrier modules 210 shown in FIGS. 35-41, connected end-to-end, using pin and lug connections as has been described previously in connection with prior embodiments. However, this array 72 is an end treatment array. End treatment arrays are known in the prior art, and have been briefly discussed above, in conjunction with prior disclosed embodiments. The concept of an end treatment or end treatment array is to secure a crash attenuating device to the front end of a substantially immovable structure, such as a bridge abutment, pillar, or the like, so that an impacting vehicle, rather than crashing directly into the substantially immovable structure, will impact the end treatment array and "ride down" before reaching the immovable structure, thereby protecting the vehicle occupants from serious injury or death.

In the present invention, the end treatment array 72 comprises a plurality of barrier modules 210, secured to one another as shown, and as described above. However, on each end of the array 72 is positioned a transition barrier module 74.

The transition barrier module 74 is illustrated more particularly in FIGS. 47-50 and 59-62, for example. In many respects, the transition barrier module 74 is constructed similarly to regular barrier modules 210, except that it is preferably differently colored, for ready identification. For example, in certain preferred embodiments, the transition barrier module 74 is yellow, while regular barrier modules 210 are orange and white. Additionally, because it is desired that the transition barrier module 74 always be empty, rather than filled with ballast, it may be constructed without a ballast fill hole, and may alternatively or additionally be constructed to have substantial (perhaps approximately 1½ inch diameter) holes near its base to ensure that the hollow barrier module 74 is never filled.

Figure 52:
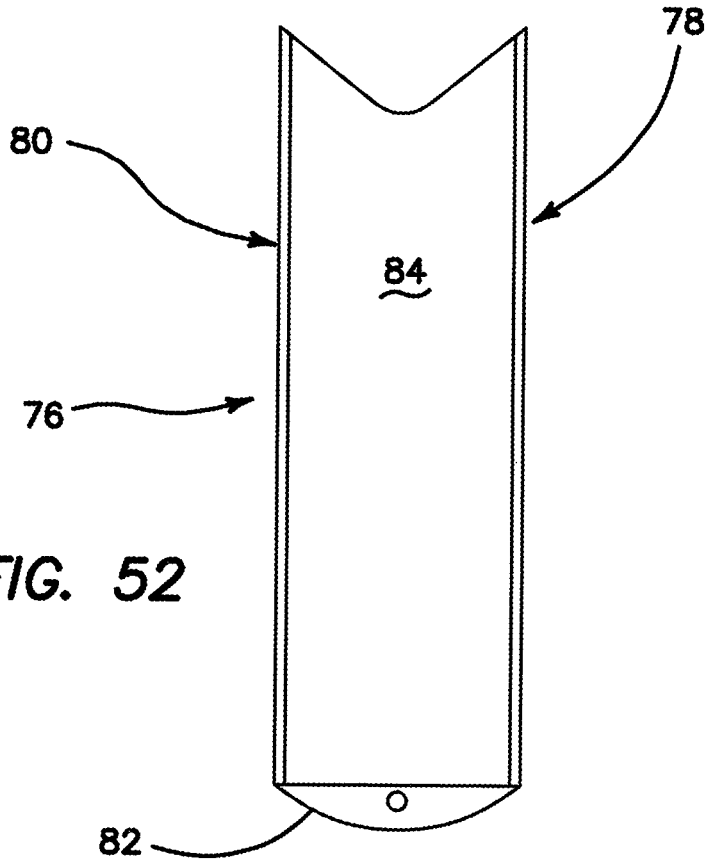
FIG. 52 is a top view of the sled of FIG. 51.
Figure 53:
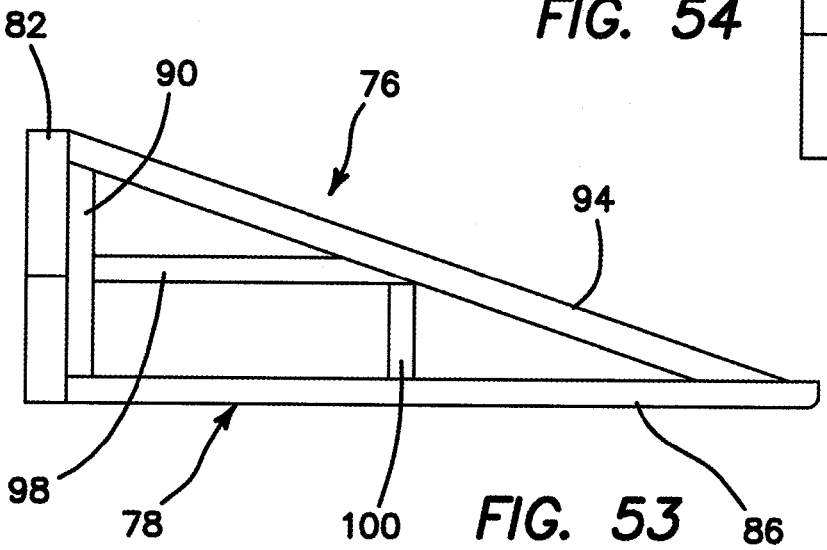
FIG. 53 is an elevational view of the sled of FIG. 51.
Figure 54:
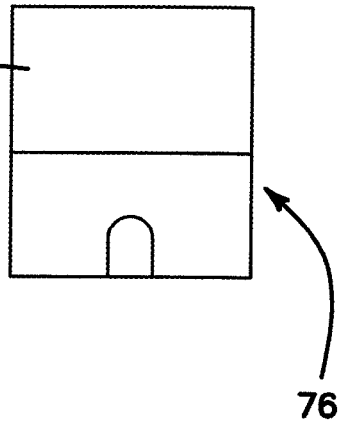
FIG. 54 is an end view of the sled of FIG. 51.

A very significant improvement in the inventive end treatment array 72 is the employment of a containment impact sled 76, shown, for example, in FIGS. 45-54. The containment impact sled 76 comprises a frame having side frame members 78, 80, each joined to opposing edges of a front cap 82 and a floor portion 84 (FIG. 52). The frame is preferably made of galvanized steel, having a steel tube frame and sheet metal construction, though other suitable structural materials may also be used.

The side frame members 78, 80 are each generally triangular in shape, each comprising, respectively, a bottom frame member 86, 88, extending lengthwise along the floor portion 84 from the front cap 82 to the opposing end of the floor portion 84, a cap end frame member 90, 92, and a top frame member 94, 96. The top frame member 94, 96 extends from an upper end of its respective cap end frame member 90, 92, and the front cap 82, downwardly toward the opposing end of each respective bottom frame member 86, 88, as shown in the drawings.

Additional right frame brace members 98, 100 and left frame brace members 102, 104 are preferably employed to reinforce the strengthen the structural integrity of the containment impact sled 76.

Thus, the containment impact sled 76 is a longitudinal energy disperser which comprises a structure having a defined volume, supported by the floor portion 84 and contained by the side frames 78, 80 and front cap 82. The function of this volume, as will be described below, is to collect and contain debris resultant from the impact of a vehicle with the barrier array 72, thus preventing that debris from flying about, striking adjacent people, vehicles, and/or structures, or collecting underneath the impacting vehicle and causing that vehicle to ride up over that debris and flip over, or "vault".

Figure 57:
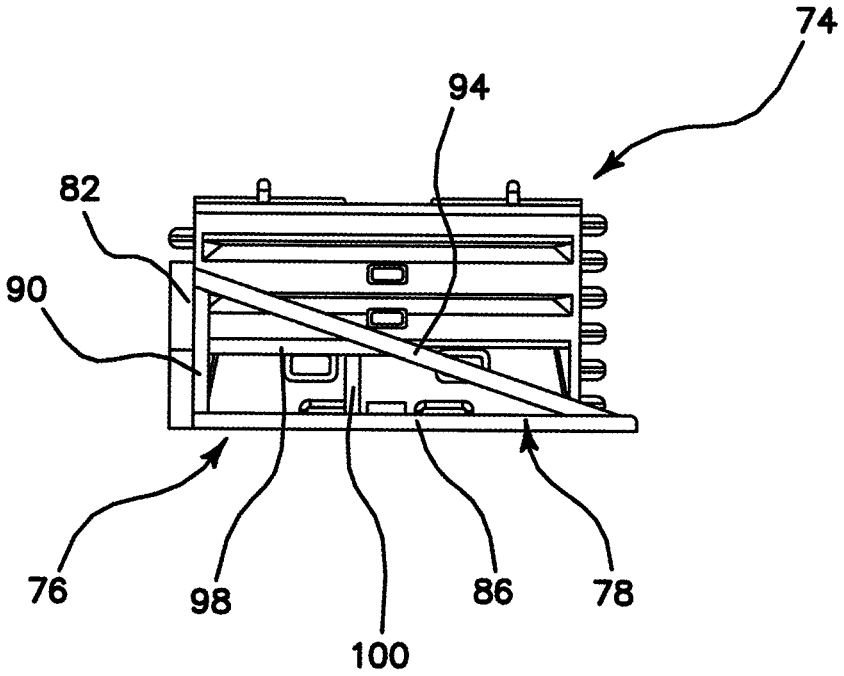
FIG. 57 is a right-side plan view of a sled and barrier transition module assembly in accordance with the present invention.
Figure 58:
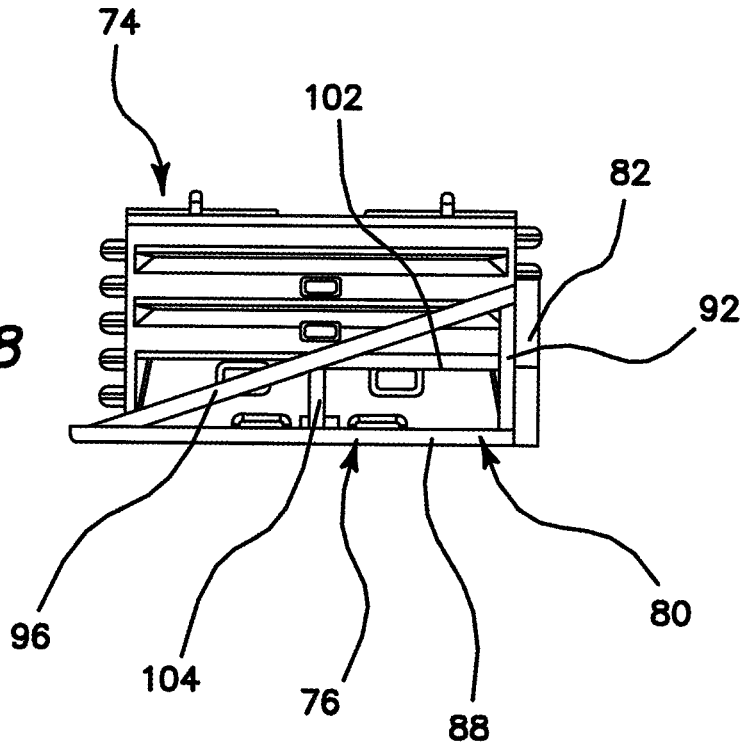
FIG. 58 is a left-side plan view of the assembly shown in FIG. 57.
Figure 59:
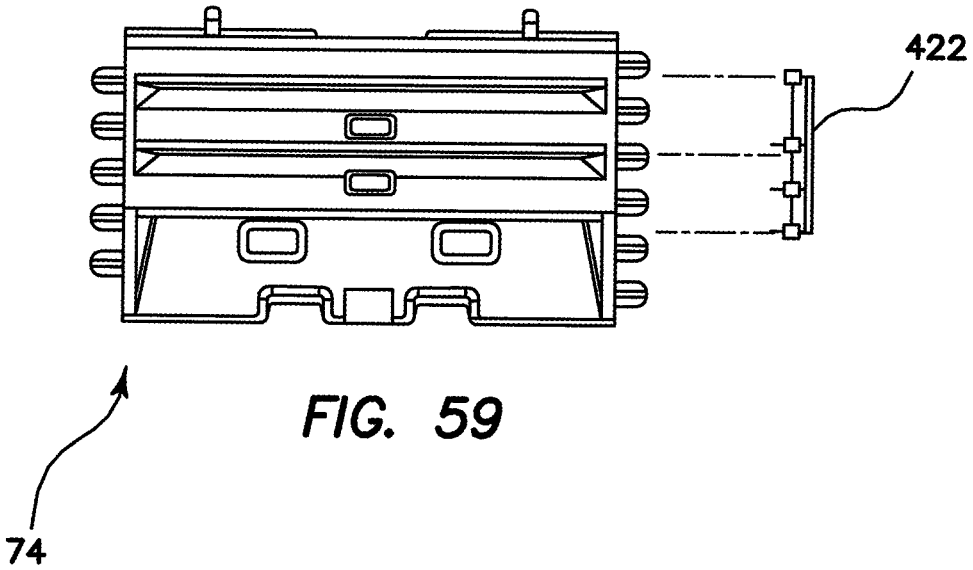
FIG. 59 is a plan view of a barrier transition module, showing end treatment hardware for attachment to an end thereof.

As illustrated in FIGS. 45-50, for example, the containment impact sled 76 is configured to be attached to one end of a transition barrier module 74. Attachment is accomplished by sliding the transition barrier module 74 into the sled 76, so that the barrier module 74 rests on the floor 84 of the sled 76. The barrier module 74 may be oriented in either direction, so that either end, i.e. the end having five lugs 218 or the end having six lugs 218, faces the inside surface of the front cap 82. This capability for dual orientation is shown, for example, in FIGS. 47-48 and 58, where the six lug end is secured to the front cap, and in FIGS. 49-50 and 57, where the five lug end is secured to the front cap.

Figure 56:
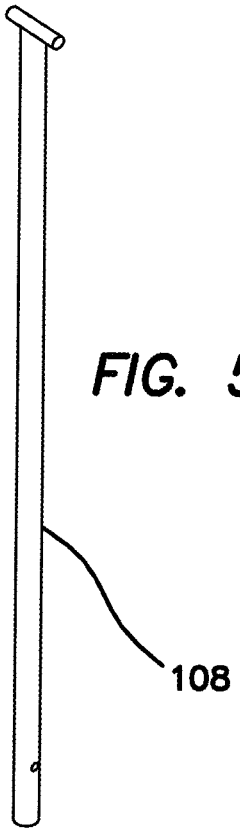
FIG. 56 is an isometric view of the pin of FIG. 55.
Figure 55:
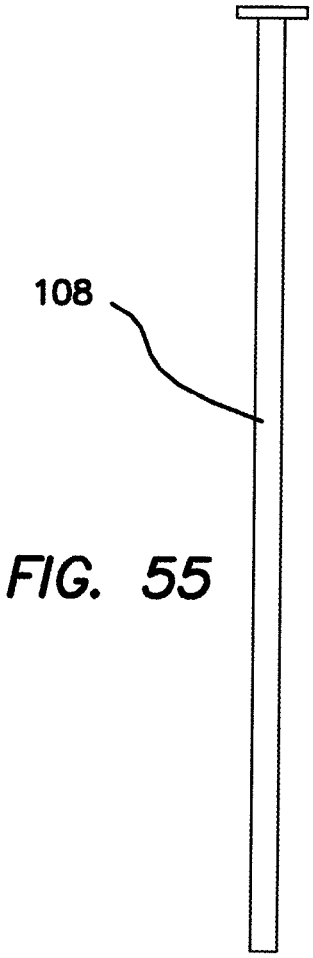
FIG. 55 is a plan view of a pin for use in securing the sled to the barrier transition module.

Once in place, the barrier module 74 is oriented so that a pin hole 106 in the front cap 82 is aligned with the pin holes 224 in each respective lug 218, as shown. A t-pin 108, as shown in FIGS. 55 and 56, is then disposed through the hole 106 and each lug hole 224 to secure the sled 76 to the barrier module 74.

Figure 60:
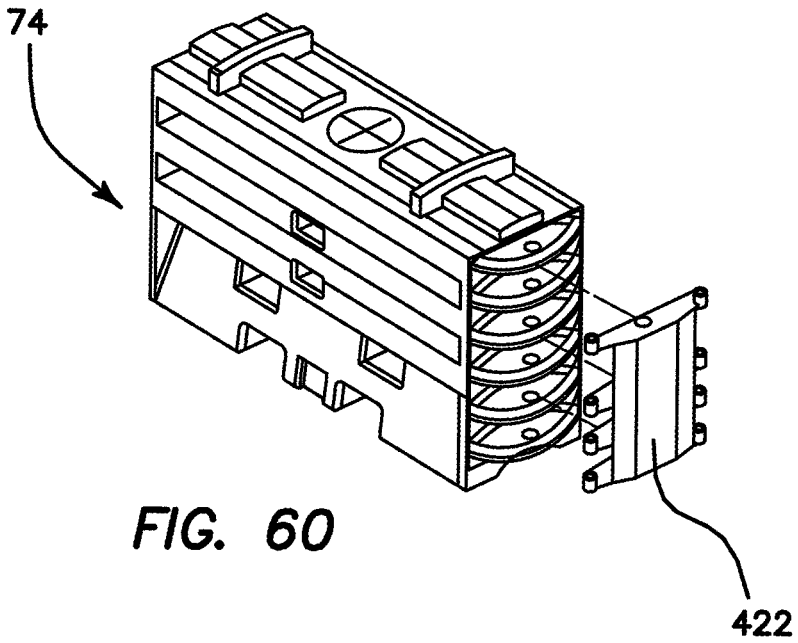
FIG. 60 is an isometric view of the assembly shown in FIG. 59.
Figure 61:
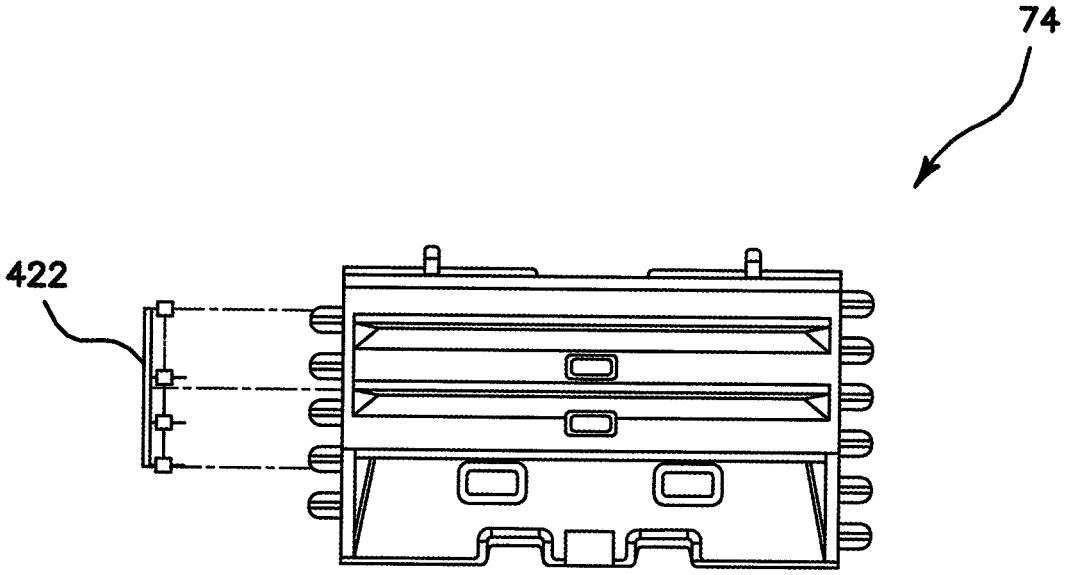
FIG. 61 is a plan view similar to FIG. 59, showing the end treatment hardware for attachment to an opposing end of the barrier transition module.
Figure 62:
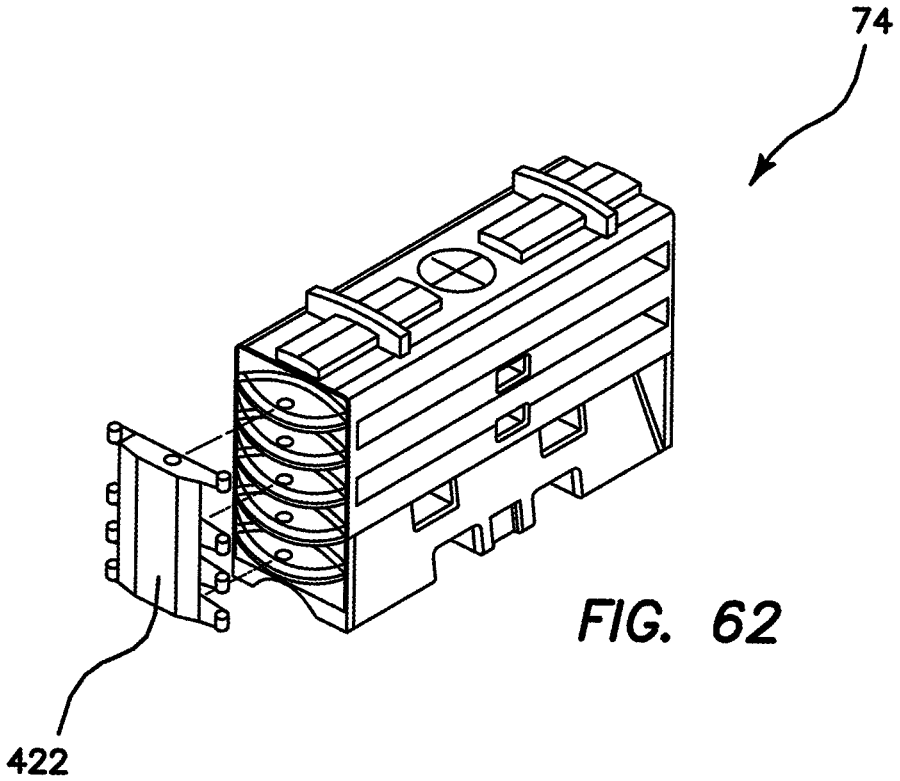
FIG. 62 is an isometric view of the assembly shown in FIG. 61.
Figure 64:
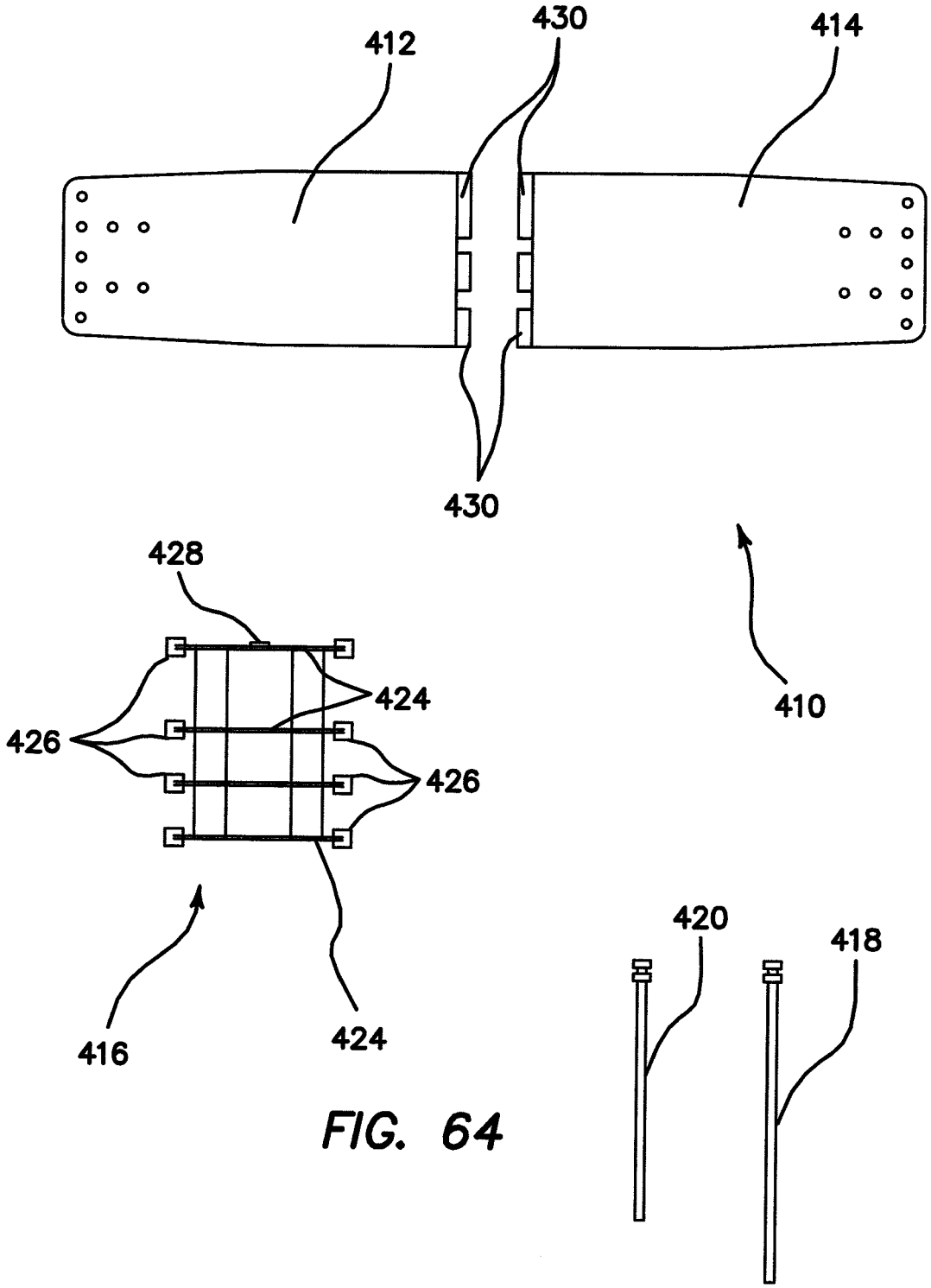
FIG. 64 is a plan view of the assorted hardware forming the set of end treatment hardware for securing the end treatment array to a fixed structure.

As noted above in connection with FIGS. 44-46, depicting the end treatment array 72, in addition to the end of the array 72 which includes the sled 76, there is a second transition barrier module 74 at the opposing end of the array, for the purpose of securing the array 72 to a fixed structural member which the array is positioned to shield from an impacting vehicle, such as a bridge abutment or the like. As is the case with the first transition barrier module 74, one end of this second transition barrier module is secured to an opposing end of a regular barrier module 210, as shown. However, the opposing end of this second transition barrier module 74 is fitted with end treatment hardware 410, which is shown as a set in FIGS. 63 and 64. This hardware 410 comprises a left panel 412, a right panel 414, a frame 416, a long pin 418, two short pins 420, and a cap panel 422 (FIG. 60).

As shown in FIGS. 59-63, the end treatment hardware 410 is assembled to the end of the second barrier module 74. Specifically, the frame 416 comprises horizontal cross-members 424 secured at either end to short vertical hollow hinge posts 426. The horizontal cross-members 424 each include a pin hole 428. The frame 416 is assembled to the left and right panels 412, 414, respectively, by assembling the short vertical hollow hinge posts 426 to interleave with respect vertical hollow hinge posts 430 disposed on each of the left and right panels 412, 414, respectively, so that they are aligned. The short pins 420 are then inserted through each of the short vertical hollow hinge posts 426 and 430, as shown in FIG. 63, to thereby secure the frame 416 to each of the left and right panels 412 and 414. The securement method is such that the panels 412, 414 are pivotable relative to the frame 416, about the axis of each short pin 420.

As shown in the Figures, at the same time the frame 416 is situated so that the pin holes 428 in each horizontal cross-member 424 of the frame 416 are interleaved with, and aligned with the pin holes in the lugs 218 of the barrier module 74. As shown, the end treatment hardware 410 can be adapted to fit to either the six-lug or five-lug end of the barrier module 74 by appropriately positioning the frame relative to the lugs. Once the holes in the lugs and in the frame cross-members 424 are aligned, the long pin 418 may be inserted through those aligned holes to join the hardware 410 to the barrier module 74.

As shown in FIGS. 59-62, the cap panel 422 may be secured with the frame 416 to the barrier module.

A significant advantage of the hardware system 410 is that, because of the hinged left and right panels 412, 414, the barrier module 74 may be secured to structures of differing sizes. To complete this attachment, the panels 412, 414 are pivoted until the extend rearwardly along the opposed sides of the abutment or other structure, at which time suitable fastening hardware 432 is inserted through the respective holes 434 in each panel to secure the panels respectively to each side of the abutment.

In operation, when the end treatment array 72 is impacted by a vehicle, the empty forward barrier module 74 quickly crumples from the impact. The sled, joined to this module as described above, moves rearwardly as the module 74 crumples, scooping up and containing the debris within its volume onto its deck, thus preventing that debris from getting loose and potentially vaulting the vehicle. As the ensuing ballasted modules 210 deform, rupture, and release their ballast, the sled moves rearwardly into the array, scooping up additional deformed and ruptured modules and continuing to contain debris until the vehicle is safely stopped. The inventive system functions as a non-redirective, gating, crash cushion.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An end treatment array for attenuating the forces generated by a vehicular impact, comprising:

a transition barrier module fabricated of plastic and comprising first and second side walls, first and second end walls, a top wall, and a bottom wall, the module walls together defining a substantially enclosed interior space which is hollow, the transition barrier module having a predetermined width and length; and a containment impact sled comprising an axially extending frame, said frame having a width sufficient to contain the transition barrier module within said frame when in an assembled configuration, and having an axial length which is at least one-half the length of said transition barrier module, the frame having an open end and an upright wall closing a second end thereof and defining an interior volume adapted for capturing debris during a vehicular impact;

wherein the upright wall of the containment impact sled is attached to one end of the transition barrier module in said assembled configuration, so that the transition barrier module is disposed in said interior volume.

2. The end treatment array as recited in claim 1, wherein the transition barrier module interior space is unfilled with any ballasting material.

3. The end treatment array as recited in claim 1, wherein the containment impact sled further comprises a floor.

4. The end treatment array as recited in claim 3, wherein the containment impact sled frame comprises a first side frame member attached to one side of said floor and upright wall and a second side frame member attached to an opposing side of said floor and said upright wall.

5. The end treatment array as recited in claim 4, wherein each of said side frame members comprise a bottom frame member and a top frame member, wherein the bottom frame member is disposed substantially horizontally, and the top frame member extends downwardly at an angle from its frontmost end to its rearmost end, with the frontmost end of the top frame member being connected to said upright wall near a top of said upright wall and the rearmost end of the top frame member being connected to a rearmost end of the bottom frame member near ground level, such that each side frame member is triangular in shape.

6. The end treatment array as recited in claim 1, and further comprising:

apertures in each of said transition barrier module and said sled which are aligned when the transition barrier module and the sled are in said assembled configuration; and a pin extending through said aligned apertures in said assembled configuration to attach the transition barrier module to the sled.

7. The end treatment array as recited in claim 6, wherein the transition barrier module comprises a plurality of vertically spaced lugs on the first end wall, each of said lugs having one of said apertures therein for receiving said pin.

8. The end treatment array as recited in claim 6, wherein one of said apertures is disposed in an upright wall of the sled.

9. The end treatment array as recited in claim 1, wherein the transition barrier module comprises holes in a lower end thereof to prevent the containment of ballasting material in said interior space.

10. The end treatment array as recited in claim 7, and further comprising a plurality of vertically spaced lugs on the second transition barrier module end wall, for attaching the transition barrier module to a first end of an adjacent barrier module.

11. The end treatment array as recited in claim 10, wherein said adjacent barrier module is also a transition barrier module, constructed similarly to the first transition barrier module, and is also unfilled with ballasting material.

12. The end treatment array as recited in claim 1, and further comprising a barrier module connected at a first end to the transition barrier module which is filled with a ballasting material.

13. The end treatment array as recited in claim 12, wherein the ballasting material comprises water.

14. The end treatment array as recited in claim 12, and further comprising a second transition barrier module connected at a first end thereof to a second end of the barrier module, the second transition barrier module being constructed substantially similarly to the first transition barrier module and being unfilled with ballasting material.

15. The end treatment array as recited in claim 14, and further comprising end treatment hardware for attaching a second end of the second transition barrier module to a fixed structure.

16. The end treatment array as recited in claim 15, wherein said end treatment hardware comprises a frame which is securable to the second end of the second transition barrier module.

17. The end treatment array as recited in claim 16, wherein the end treatment hardware frame is comprised of metal.

18. The end treatment array as recited in claim 17, wherein the end treatment hardware frame comprises a plurality of vertically spaced horizontal cross members, each of which has an aperture in a middle portion thereof for receiving a pin, wherein in an assembled state the apertures are aligned.

19. The end treatment array as recited in claim 12, wherein the transition barrier module and the ballast-filled barrier module are differently colored.

20. The end treatment array as recited in claim 18, the end treatment hardware further comprising:

first and second hinge posts disposed at opposing ends of each of the assembled vertically spaced horizontal cross members;

a first hinge pin;

a second hinge pin;

a left panel; and a right panel;

wherein the left panel is pivotally securable to aligned first hinge posts using said first hinge pin and the right panel is pivotally securable to aligned second hinge posts using said second hinge pin, so that the left and right panels can be rotated to extend along a length of said fixed structure.

21. The end treatment array as recited in claim 20, wherein each of said left and right panels have apertures therein for receiving hardware to secure each panel to said fixed structure.

22. The end treatment array as recited in claim 20, and further comprising a pin for insertion into the aligned apertures on each of said plurality of vertically spaced horizontal cross members.

* * * * *